US006484000B1

(12) United States Patent
Ogawa et al.

(10) Patent No.: US 6,484,000 B1
(45) Date of Patent: Nov. 19, 2002

(54) SEALING MEMBER WHICH PREVENTS CONTAMINATION WHEN REMOVED AND CONTAINER HAVING THE SEALING MEMBER

(75) Inventors: Moriaki Ogawa, Tokyo; Keiji Okamoto, Yokohama, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/137,423

(22) Filed: Aug. 20, 1998

(30) Foreign Application Priority Data

| | | |
|---|---|---|
| Aug. 21, 1997 | (JP) | 9-242125 |
| Jan. 22, 1998 | (JP) | 10-026772 |
| Feb. 13, 1998 | (JP) | 10-048817 |
| May 13, 1998 | (JP) | 10-148448 |
| Jul. 13, 1998 | (JP) | 10-214903 |

(51) Int. Cl.[7] ..... G03G 15/08
(52) U.S. Cl. ..... 399/106; 399/102; 399/105
(58) Field of Search ..... 399/102, 103, 399/105, 106, 98; 222/DIG. 1

(56) References Cited

U.S. PATENT DOCUMENTS

| | | | | |
|---|---|---|---|---|
| 4,969,557 A | * | 11/1990 | Oka | 206/527 |
| 4,998,140 A | * | 3/1991 | Satou et al. | 399/105 |
| 5,207,353 A | * | 5/1993 | Corby et al. | 141/364 |
| 5,212,521 A | | 5/1993 | Ogawa et al. | |
| 5,621,508 A | * | 4/1997 | McNamara | 399/106 |

FOREIGN PATENT DOCUMENTS

| | | |
|---|---|---|
| JP | 6-258936 | 9/1994 |
| JP | 9-329951 | * 12/1997 |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A sealing member for sealing an opening of a container is provided with a sealing face facing contents in the container. This sealing face is formed into a shape without being externally exposing during an unsealing operation of the sealing member. The container can include the opening sealed with the sealing member, and a seal taking-out hole for taking out the sealing member when the opening is unsealed. A sealing member can include a leader for pinching the sealing member when the sealing member is peeled off from the container, and the leader can be inserted through the seal taking-out hole so that an opening sealing-face of the sealing member is bent inside when the unsealing operation of the sealing member is performed. A convex protrusion having a shape such that a face of the sealing member can be bent can be mounted on the seal taking-out hole. The sealing member for sealing an opening of the container can be formed into a cylindrical shape with a flexible material, and a part of an outer peripheral face of the sealing member seals the opening.

38 Claims, 31 Drawing Sheets

SEALING MEMBER WHICH PREVENTS CONTAMINATION WHEN REMOVED AND CONTAINER HAVING THE SEALING MEMBER

BACKGROUND OF THE INVENTION

1. Field of the Invention

The present invention relates to a sealing member for sealing an opening of a container, and a container having the opening sealed with the sealing member, the container having a hole for taking out the sealing member when the sealing member is unsealed.

2. Discussion of the Background Art

A sealing member for sealing an opening of a container is well known. For example, a sealing member has been used on a toner container, toner hopper, and the like, and incorporated to a machine such as a copying machine, a facsimile machine, a printer, and the like, which is disclosed in, for example, Japanese Laid-Open Patent Publication No. 4-136961/1992 (hereinafter referred to as background art 1), Japanese Laid-Open Patent Publication No. 5-80653/1993 (background art 2), Japanese Laid-Open Patent Publication No. 5-197287/1993 (background art 3), Japanese Laid-Open Patent Publication No. 5-204246/1993 (background art 4), and Japanese Laid-Open Patent Publication No. 7-121019 (background art 5).

The sealing member disclosed in the aforementioned background arts 3 and 4 is mounted so that the sealing member seals the opening from one end towards another end, and from one end to approximately a middle part of the sealing member having an adhesive portion, and a rest of the sealing member which exceeds the length of the opening in a longitudinal direction is folded back to the side of the first end of the sealing member, and a folding portion at a side end of the opening is used as a knob portion for operation (a leader for pinching the sealing member). That is, the opening is constructed so that the sealing member can be removed from the opening by pulling out the sealing member and pinching the knob portion thereof, when the sealing member is unsealed.

An example of such a sealing member is shown in FIG. 31. Referring to FIG. 31, edge portions of four sides of a pulling-out seal 104 as a sealing member are adhered to a seal adhering-face 103 of a toner-supplying outlet 102 formed on a toner case 101 as a toner container supplying toner to a developing device (not shown). Thereby, the toner-supplying outlet 102 is sealed. When the seal of the toner-supplying outlet 102 is unsealed, an operator pulls out the pulling-out seal 104 in a direction indicated by a white arrow shown in FIG. 31, pinching the knob-end 104*a* thereof. Thereby, the pulling-out seal 104 is peeled off from the seal adhering-face 103 on the backside of the toner case 101, and the seal of the toner-supplying outlet 102 is unsealed.

However, a sealing face of the sealing member 104 which faces the contents (for example, a developer such as toner) inside the toner case 101 is externally exposed when the sealing member 104 is unsealed by being peeled off, and at a time of throwing away the sealing member. As a result, toner taken off from the opening (toner-supplying outlet 102) of the toner case 101 in this kind of sealing member 104 has a strong possibility of dirtying an operator's hands, clothing, and the like, with contents (for example, toner, or the like developer) which are stuck to the sealing-face of sealing member 104.

In contrast, a sealing member can be constructed to be made of a sheet-like shape having an opening at a part which can be wound so that open/close operations of the sealing member are automatically performed by moving the sealing member to the opening of the toner container. Such a device for winding a sealing member is disclosed in the aforementioned background art 1, and in this disclosed construction the toner-supplying outlet 102 of the toner hopper is sealed with an end of the sealing member, and another end of the sealing member is fixed at an agitation member in the toner hopper. Further, a sealing member is wound with a rotation of the agitation member in the aforementioned background art 2. Since in this art the open/close operations of the sealing member are automatically performed, and the sealing member can be easily wound at a side of the container after an unsealing operation is performed, there is less possibility that the operator's hand and clothing is dirtied with the contents (for example, a developer such as toner) stuck to the opening sealing-face of the sealing member.

However, these background arts 1 and 2 have a complicated construction and the mounting method of the sealing member is not easy, and manufacturing costs may be increased accordingly.

Furthermore, the background art 5 is another art relevant to a sealing method for sealing an opening of a toner container with a sealing member. This art discloses a device such that when an opening of a toner container is sealed, an elastic element sheet is detachably mounted at an end of a longitudinal direction of an inserting member, and the elastic element sheet is led to a position for sealing the opening by penetrating the inserting member through a gap between the toner container and a developing device frame. Subsequently, the opening of the toner container is sealed as if the elastic element sheet is detached from the inserting member. However, since this operation procedure is complicated and the operation includes many steps, this method is not considered practical.

On the other hand, in a cartridge as a container, such as a toner cartridge or a process cartridge, having a construction in which an opening of a developer containing section for containing toner or the like developer as contents is sealed with the aforementioned sealing member, a seal taking-out hole for taking out the sealing member when the sealing member is unsealed is formed on the side of the cartridge housing. A maximum size of the seal taking-out hole formed on the side portion of the cartridge housing has been hitherto formed larger than a width of the sealing section that is rectangular to the opening direction of the sealing member so that the aforementioned sealing member can be pulled out with relative ease. However, the seal taking-out hole formed on the side portion of the container, such as the cartridge, is in a state of being connected to the containing section in an opening state of the opening of the containing section for the contents such as the developer after the sealing member is unsealed.

Accordingly, there is a problem that if the seal taking-out hole is kept open, contents contained in the containing section flow out through the seal taking-out hole formed on the side portion of the container in this kind of hitherto provided container. Therefore, in this kind of hitherto provided container, the seal taking-out hole is sealed with the taking-out hole sealing member for preventing the flowing out of the contents from the seal taking-out hole of the container after the opening of the container is opened by pulling out the sealing member via the seal taking-out hole. However, if a size of the seal taking-out hole of the container is large, a pressure of the contents contained in the container forced to flow out from the seal taking-out hole becomes high, and accordingly, there is a problem in which a sealing performance of the taking-out hole sealing member that seals the seal taking-out hole deteriorates.

Further, in a case that a shape and a size of the opening of the container are different, the shape and the size of the seal taking-out member for sealing the opening are different, and the shape and the size of the seal taking-out hole individually is in a different shape and size corresponding to the shape and the size of the sealing member. Accordingly, in hitherto used containers, the taking-out hole sealing members having individually a different shape and size are required to be prepared corresponding to the shape and the size of the seal taking-out holes, and therefore, there has been a problem that selection of the sealing member for the taking-out hole becomes complicated.

SUMMARY OF THE INVENTION

The present invention is made in light of the above problems, and it is an object of the present invention to provide a novel container and sealing member having a simple and inexpensive construction capable of preventing dirtying of an operator's hands, clothing, and the like, due to contacting contents of a developer container stuck to a sealing member.

It is another object of the present invention to provide a novel container capable of suppressing flowing-out of its contents, and for which it is easy to select a sealing member for a taking-out hole that is additionally required.

As one feature, the novel sealing member is provided for sealing an opening of a container in which an opening sealing-face of the sealing member facing contents in the container is formed into a shape without being externally exposed, in accordance with an unsealing operation of the sealing member.

The novel sealing member can include a leader for pinching the sealing member when the sealing member is peeled off from a container, and the leader can extend outside of the container through a seal guide hole for forming the sealing member so that the opening sealing-face is formed into a shape without being externally exposed. A container can include an opening sealed with the novel sealing member, and a seal taking-out hole for taking out the sealing member when the opening is unsealed. A maximum measure of the seal taking-out hole can be formed into a size smaller than a width of a sealing portion rectangular to an unsealing direction of the sealing member. Further, a convex portion having a shape such that a face of the sealing member can be bent can be mounted on the seal taking-out hole. A covering portion can be provided for covering the opening sealing-face along with an unsealing operation for the opening from an end portion. The sealing member can also be formed into a cylindrical shape with a flexible material, and a part of the outer peripheral face of the sealing member seals the opening.

In a further feature, the novel sealing member can be composed of a lower sheet for sealing an opening of a container capable of being peeled off and an upper sheet fixed on the lower sheet with a pair of parts extending respectively in a peeling off direction, facing each other, in which an opening sealing face of the lower sheet which faces contents in the container when the opening is sealed enters between the lower sheet and the upper sheet during a peeling off operation of the sealing member from an end portion of the opening.

The novel container can also include an opening sealed with a sealing member having a leader, and a seal taking-out hole for taking out the sealing member when the opening is unsealed, in which the seal taking-out hole is sealed with a seal taking-out hole sealing member for preventing leakage and scattering of contents from the seal taking-out hole due to an unsealing of the opening by removing the sealing member, in which the taking-out hole sealing member is previously mounted at the seal taking-out hole of a container, preventing leakage and scattering of the contents, having a seal insertion hole for inserting the sealing member, in a state of the leader of the sealing member being externally exposed from the container through the seal insertion hole.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
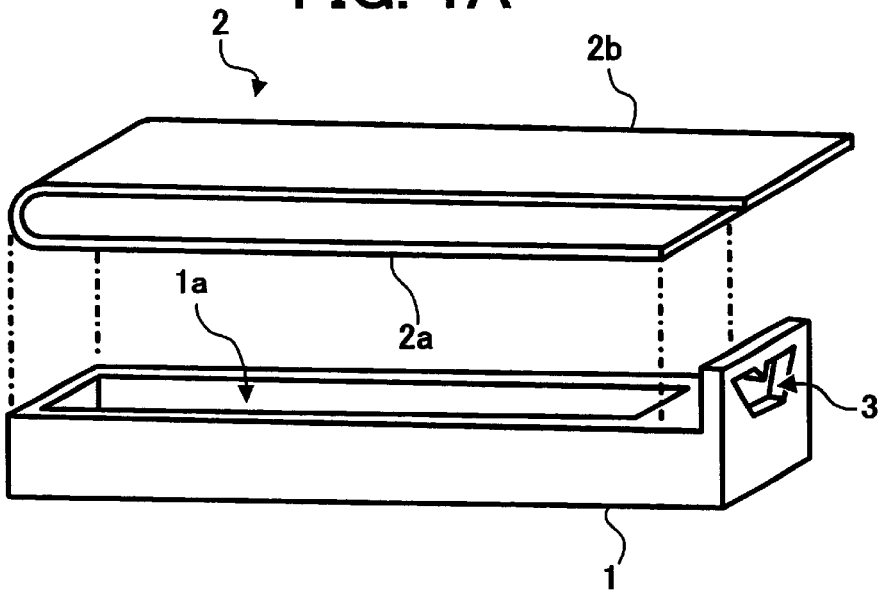
FIG. 1A is a perspective view of a construction of a sealing member and a container of the present invention.

Embodiments of the present invention are described in detail referring to the figures, wherein like reference numerals indicate identical or corresponding parts throughout the several views.

An embodiment of the present invention, which is applied to a sealing member for sealing an opening of a versatile container whose contents are not specified is described hereinbelow.

In FIG. 1A, a container 1 is formed in a shape of a relatively long rectangular parallelepiped, and a rectangular opening 1*a* along a longitudinal direction of the container 1 is located at one face (the upside face in FIG. 1A) in a longitudinal direction of the container 1. The opening 1*a* of the container 1 is sealed with a sealing member 2 by heat-melting adhesion or any other adhesion after predetermined contents are placed in the container 1, so that the contents do not leak out from the opening 1*a* (see also FIG. 1B).

The contents of container 1 are not limited to a liquid, a solid, and a powder. The contents of the container 1 can be, for example, paint, printing ink, color toner, or a developer such as toner, or other contents that have a strong possibility of dirtying an operator's hands, clothing, and the like, on or after unsealing the sealing member 2 by adhering to a sealing-face 2*a* of sealing member 2 that faces the contents of the sealing member 2. Further, as a material, any of the materials such as a carton, a thin board of aluminum, polyethylene terephthalate (PET) resin, or the like, is applicable for the container 1. Furthermore, the shape of the container 1 is not limited only to the rectangular parallelepiped shown in FIG. 1. The container shape can be any shape, for example a cylindrical shape, polygonal prism, or a like other shape.

Furthermore, any material can be employed for the sealing member 2 as well as the container 1. However, for example, a high quality paper, Mylar (Polyester film), PET film, or the like material, which has a good adhesive property to the container 1 and tensile strength sufficient to withstand a tension caused by peeling of the sealing member 2 is more preferable. Furthermore, although a shape of the sealing member 2 is not particularly limited, a part of the sealing-face 2*a* is preferably formed at least in a symmetrical shape with respect to a central line in an unsealing direction of the sealing member 2.

The sealing member 2 has a leader 2*b* for pinching when the sealing member 2 is peeled off from the container 1 by the operator, and the leader 2*b* is turned back at a starting position for an unsealing operation of the sealing member 2 (left end position in FIG. 1A) in the unsealing direction of the sealing member 2 along the opening 1*a* of the container 1.

Figure 1B:
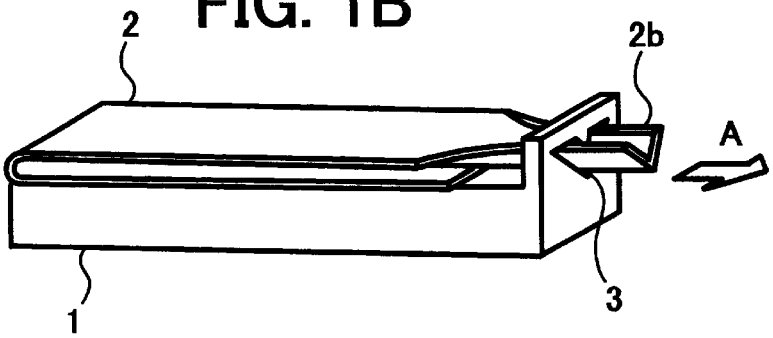
FIG. 1B is a perspective view for an unsealing operation of the sealing member of FIG. 1A.

Furthermore, the leader 2*b* extends beyond the container 1 through a seal guide hole 3 having a folio-like shape (a V-like shape in this example) with the sealing-face 2*a* inside, as shown in FIG. 1B. The seal guide hole 3 in the FIGS. 1A, 1B is formed in a body with the container 1 at an end of the sealing member in an unsealing direction thereof. However, the seal guide hole 3 may be formed at a casing of the developing device as an independent member or as a separate part, for example, in a case in which the container 1 is a toner cartridge of a developing device, or the like.

Figure 1C:
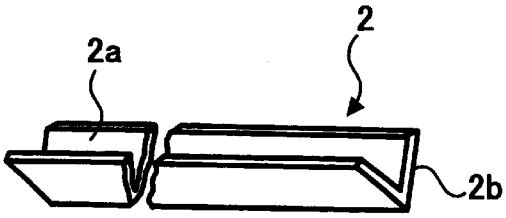
FIG. 1C is a schematic perspective view showing a shape of the sealing member of FIG. 1A after being peeled off.
Figure 1D:
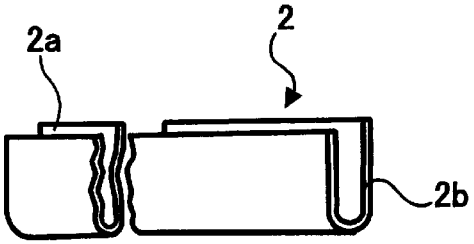
FIG. 1D is a schematic perspective view showing another shape of the sealing member of FIG. 1A after being peeled off.

Furthermore, when the operator pulls out the sealing member 2 pinching the leader 2*b* in the unsealing direction indicated by an arrow A in FIG. 1B, the sealing member 2 is folded into the folio-like shape with the sealing-face 2*a* inside according to a shape of the sealing guide hole 3, as shown in FIG. 1C, and is formed into a shape in which the sealing-face 2*a* of the sealing member 2 is not externally exposed. If the sealing-face 2*a* is formed into a shape that is not externally exposed in a state of being peeled off from the container 1, the sealing member 2 may also be shaped in a U-like shape as shown in FIG. 1D.

Thus, the sealing member 2 of this the embodiment of the present invention is formed into a shape such that the sealing-face 2*a* thereof is not externally exposed by the unsealing operation of the sealing member 2. Accordingly, when the sealing member 2 is utilized, the contents of the container 1 are prevented from being stuck to an operator's hands, clothing, and the like. This results because the contents stuck to the sealing-face 2*a* scarcely have any external contact when the sealing member 2 covering the opening 1*a* is unsealed, and when the sealing member 2 that is removed from the opening 1*a* of the container 1 is thrown away after unsealing the sealing member 2 from the opening 1*a* of the container 1.

Figure 2A:
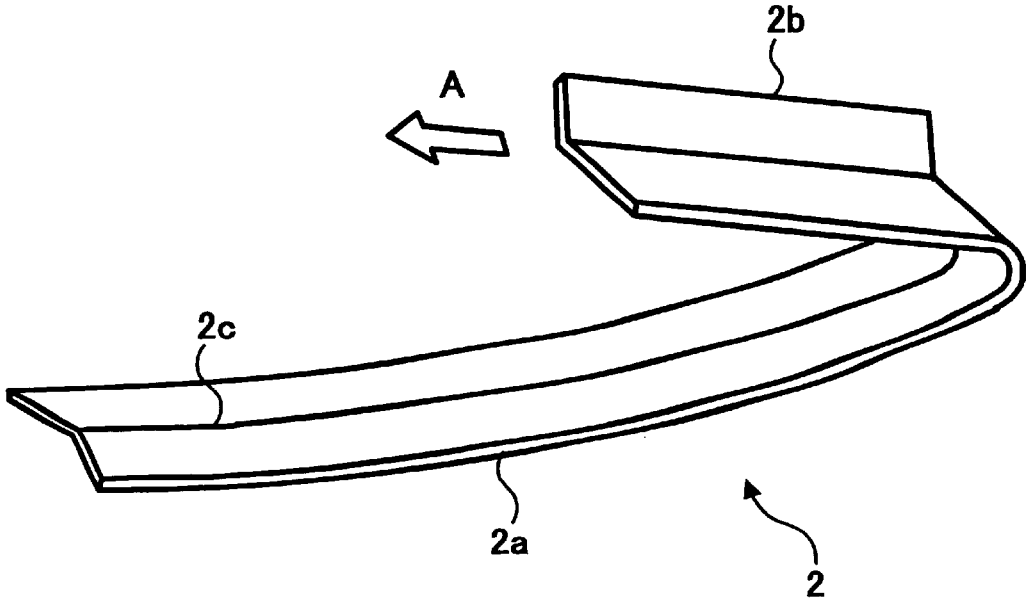
FIG. 2A is a perspective view showing another embodiment of a sealing member.

As a further feature shown in FIG. 2A, the sealing member 2 can preferably be formed previously with a crease 2*c* for folding the sealing member 2, positioning the sealing-face 2*a* thereof inside along the unsealing direction for peeling off the sealing member 2 from the aforementioned container 1. By forming the crease 2*c* on the sealing member 2, the sealing member 2 that is peeled off from the container 1 can be folded easily and accurately into the folio-like shape so that the sealing-face 2*a* is positioned inside along the crease 2*c*.

As a further modification, in a case of using the sealing member 2, the sealing member 2 can also be folded into the folio-like shape by a finger of an operator without passing the sealing member 2 through the seal guide hole 3 shown in FIG. 1A, and accordingly, a construction of the container 1 may quite be simplified. However, if the sealing member 2 is made in the folio-like shape by passing through the seal guide hole 3, the unsealing operation of the sealing member 2 can be performed more smoothly.

Figure 2B:
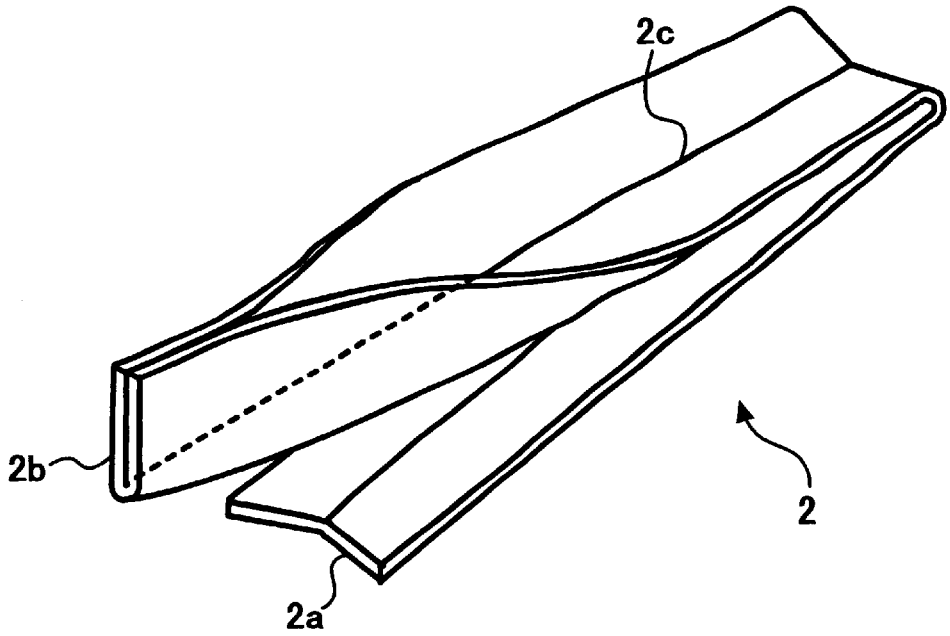
FIG. 2B is a perspective view showing still another embodiment of a sealing member.

As shown in FIG. 2B, when the leader 2*b* of the sealing member 2 is previously folded into the folio-like shape along the crease 2*c*, the sealing member 2 can easily be formed into the folio-like shape, and accordingly the unsealing operation of the sealing member 2 is made smooth. By including an adhesive adhering to the folded part of the leader 2*b*, a shape of the leader 2*b* can be easily pinched, and an effect of the previously folded shape of the leader 2*b* is not lost due to a folding back of the folded shape to an original open state. Furthermore, the crease 2*c* on the sealing member 2 may be formed on both of a whole or a part of the sealing member 2, and the crease 2*c* may be formed anywhere on the sealing member 2.

Figure 3A:
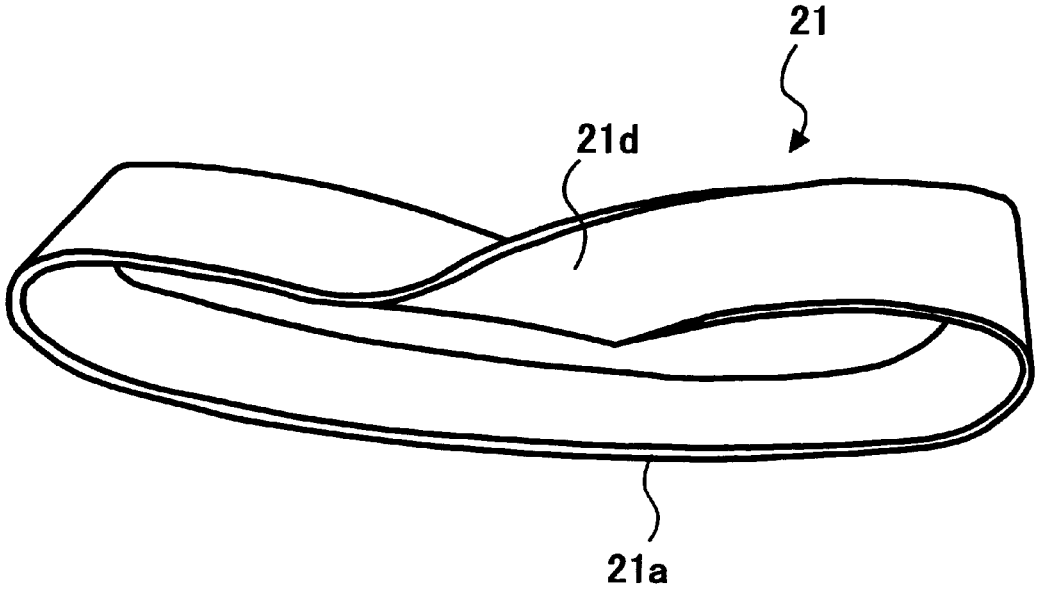
FIG. 3A is a perspective view showing still a further embodiment of a sealing member.

Another sealing member 21 of an embodiment of the present invention is shown in FIG. 3.

Figure 3B:
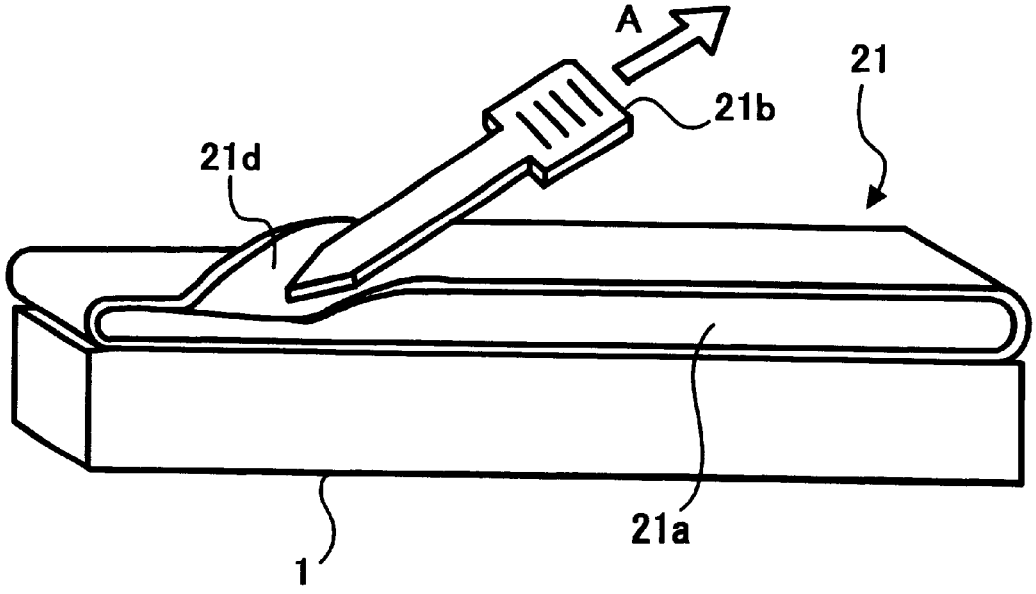
FIG. 3B is a perspective view showing a state of mounting a sealing member onto a container.

Referring to FIG. 3, the sealing member 21 is formed into a ring-like shape having a twisted portion 21*d* by connecting an upside of one end of the sealing member 21 to a downside of another end of the sealing member 21, similar to a Mobius's Ring, as shown in FIG. 3B. In addition, when the sealing member 21 is peeled off from the container 1, a leader 21*b* for pinching the sealing member 21 is formed downstream of the unsealing direction of the twisted portion 21*d*, and at a starting side of the unsealing operation (left end in FIG. 3B) of the ring-like shaped sealing member 21, as shown in FIG. 3B. The leader 21*b* may be made by adhering a separate part to the sealing member 21, or may be made of a part of the sealing member 21 bending the same.

Since the sealing member 21 is formed into a ring-like shape having a twisted portion 21*d*, which is similar to a Mobius's Ring, the sealing member 21 is turned inside out when unsealed, and is thereby twisted so that the sealing-face 21*a* is positioned inside of the sealing member 21 by peeling off the sealing member 21 from the container 1 by pinching the leader 21*b* of the sealing member 21. Accordingly, by using this sealing member 21, any contents adhering to sealing-face 21*a* can also be prevented from sticking to the hands, clothing, and the like, of an operator, since the contents stuck to the sealing-face 21*a* are scarcely externally exposed when unsealing the sealing member 21, and when the sealing member 21 which is removed from the opening 1*a* of the container 1 is thrown away after the sealing member 21 for the opening 1*a* is unsealed.

Figure 4A:
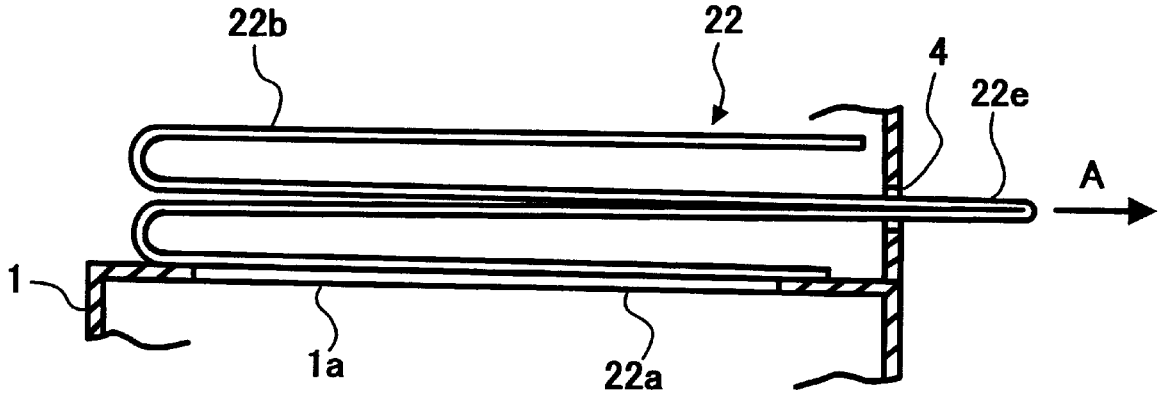
FIG. 4A is a perspective view showing a still another embodiment of a sealing member.

Another sealing member 22 of an embodiment of the present invention is shown in FIG. 4. The sealing member 22 has a relatively long leader 22*b* for pinching the sealing member when the sealing member 22 is peeled off from the container 1. The sealing member 22 has a length of at least more than two times a length of the sealing member 22 at the unsealing direction of the sealing-face 22*a* as shown in FIG. 4A. Further, the leader 22*b* is formed into the folio-like shape by being previously folded at an approximately center part of the sealing member 22. A break is made at a rectangular direction to a peeling off direction of the sealing member 22 that is peeled from the container 1. Thereby, about one half of the length of the sealing-faces 22*a* of the sealing member 22 from the center portion contacts each other facing inside.

Figure 4B:
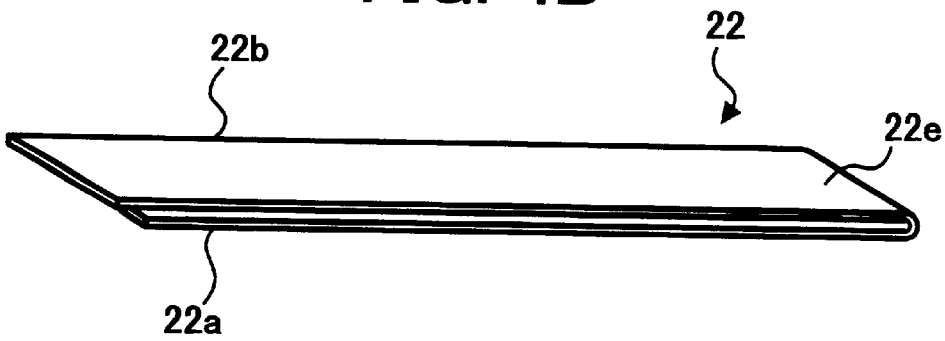
FIG. 4B is a perspective view showing a shape of the sealing member of FIG. 4A after being peeled off.

Accordingly, by peeling off the sealing member 22 from the container by pinching a turning-back end 22*e* of the leader 22*b* of the sealing member 22, the sealing member 22 is unsealed while the leader 22*b* is superposed on the sealing-face 22*a* of the sealing member 22. The sealing member 22 can thereby be peeled off from the container 1 to be formed into the folio-like shape with the sealing-face 22*a* inside as shown in FIG. 4B. Thus, the sealing member 22 is formed into the folio-like shape with the sealing-face 22*a* inside being folded at an approximately center portion thereof when the sealing operation is completed. Accordingly, when the sealing member 22 of the opening 1*a* of the container 1 is unsealed, and when the sealing member 22 is thrown away after the sealing member 22 of the opening 1*a* of the container 1 is unsealed, any contents stuck to the sealing-face 22*a* are prevented from sticking to an operator's hands, clothing, and the like. This is because the contents stuck to the sealing-face 22*a* are not externally exposed.

As shown in FIG. 4A, the sealing member 22 can securely be formed into the folio-like shape by peeling off the sealing member 22 from the container 1 passing the turning-back end 22*e* through a slit 4. The slit 4 has a width in which the turning-back end 22*e* of the leader 22*b* of the sealing member 22 can be lightly nipped. Further, since the sealing-face 22*a* of the sealing member 22 is adhered to the container 1 by an adhesive, the contents stuck to the sealing-face 22*a* can be sealed into the sealing member 22 having the folio-like shape. That is, by sealing the opening 1*a* of the container 1 with the sealing member 22 by painting an adhesive on the sealing member 22, when the sealing member 22 is peeled off from the container 1 the sealing member 22 is adhered into the folio-like shape. Thus, sticking and scattering of any contents on the sealing-face 22*a* of sealing member 22 can surely be prevented. This construction may also be employed to the aforementioned sealing members 2 and 21. Furthermore, the aforementioned slit 4 may be formed in a body with the container 1 or in a separate body from the container 1 as in the aforementioned seal guide hole 3.

Figure 5:
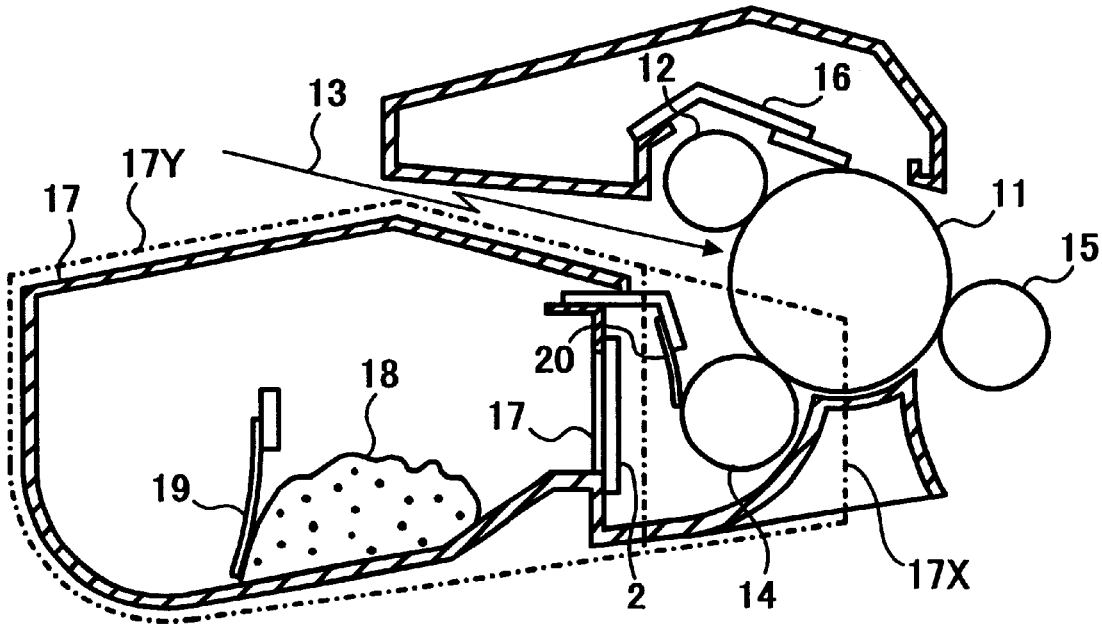
FIG. 5 is a schematic cross section showing an example in which a sealing member is incorporated with an opening of a developer container for supplying a developer mounted on a developing device of an image forming apparatus.

Another embodiment in which the present invention is applied to a sealing member for sealing an opening for supplying developer in a developing device in an image forming apparatus is described. An example of the schematic construction of a process cartridge as the aforementioned image forming apparatus is shown in FIG. 5. The image forming apparatus includes, as shown in FIG. 5, a photoconductive drum 11 as an image bearing member, a charging roller 12 as a charging device, an optical writing light 13 of an exposing device (not shown), a transfer roller 15 as a transfer device, and a cleaning blade 16 as a cleaning device.

The aforementioned devices are disposed in a housing 17 in the process cartridge respectively, and a developing section 17X and a hopper part 17Y corresponding to the container 1 are formed in the housing 17. Further, at a wall section of the housing 17 at a boundary of the developing section 17X and the hopper part 17Y, a toner-supplying outlet 17*a* is formed, and the sealing member 2 shown in FIG. 2 is mounted on the toner-supplying outlet 17*a*.

The sealing member 2 is provided to prevent a flowing out of not yet used toner 18 in the hopper part 17Y to the developing section 17X in the process cartridge. That is, the sealing member 2 prevents a toner scattering from the process cartridge. The sealing member 2 is peeled off from the toner-supplying outlet 17*a* after the process cartridge is set in a usable state.

Figure 6:
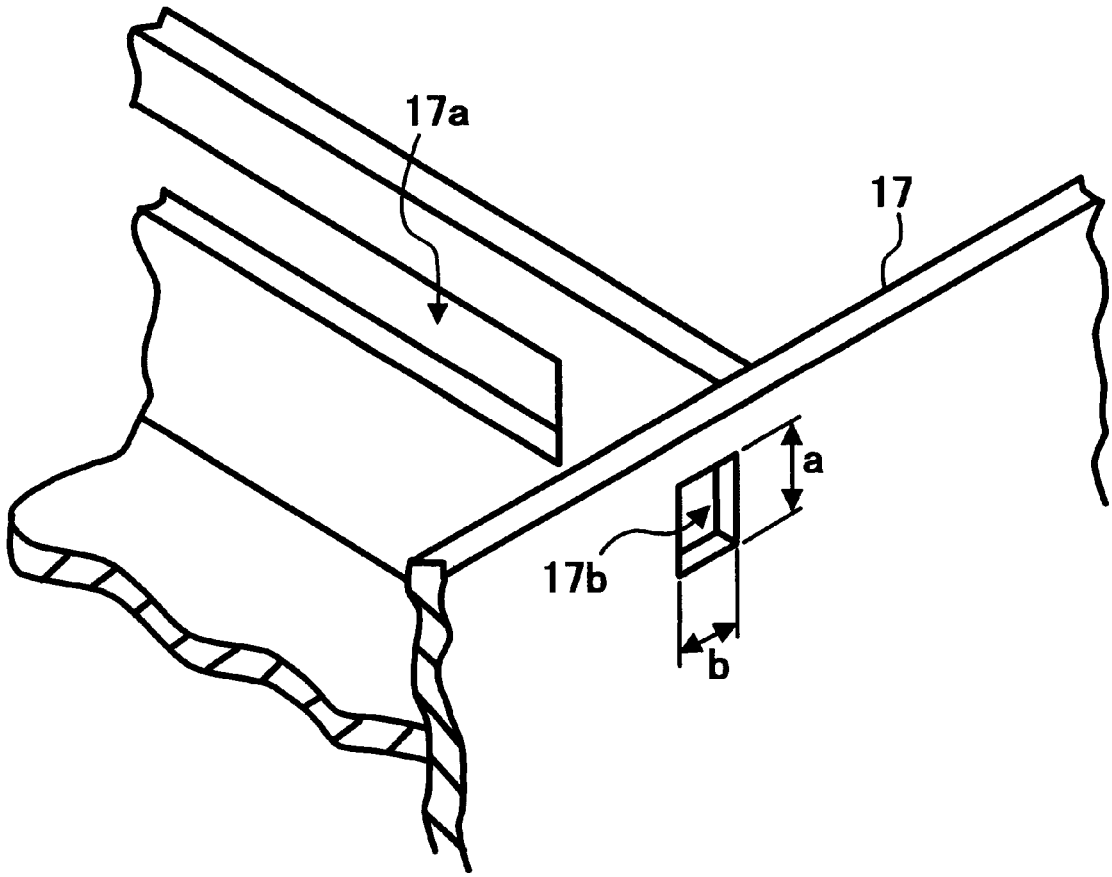
FIG. 6 is a perspective view showing a construction of a main portion of a developer container.
Figure 7:
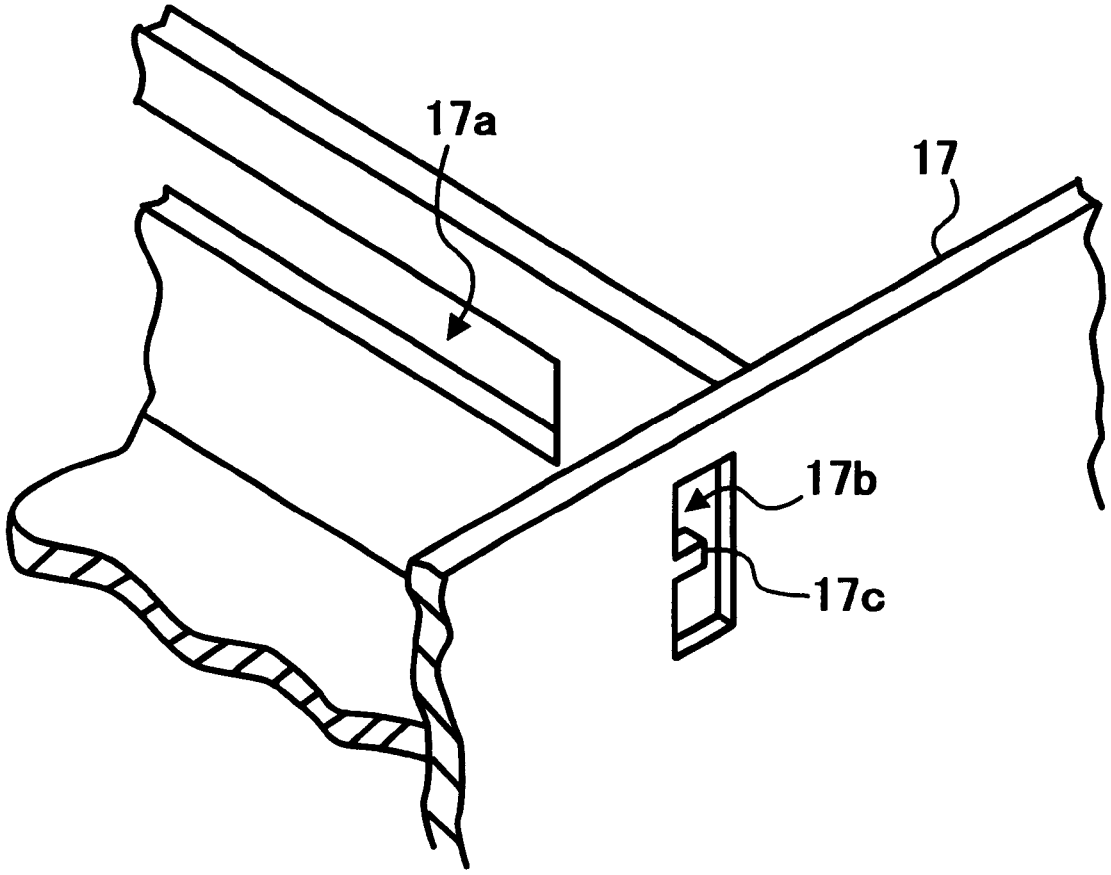
FIG. 7 is a perspective view showing another construction of a main part of a developer container.
Figure 8:
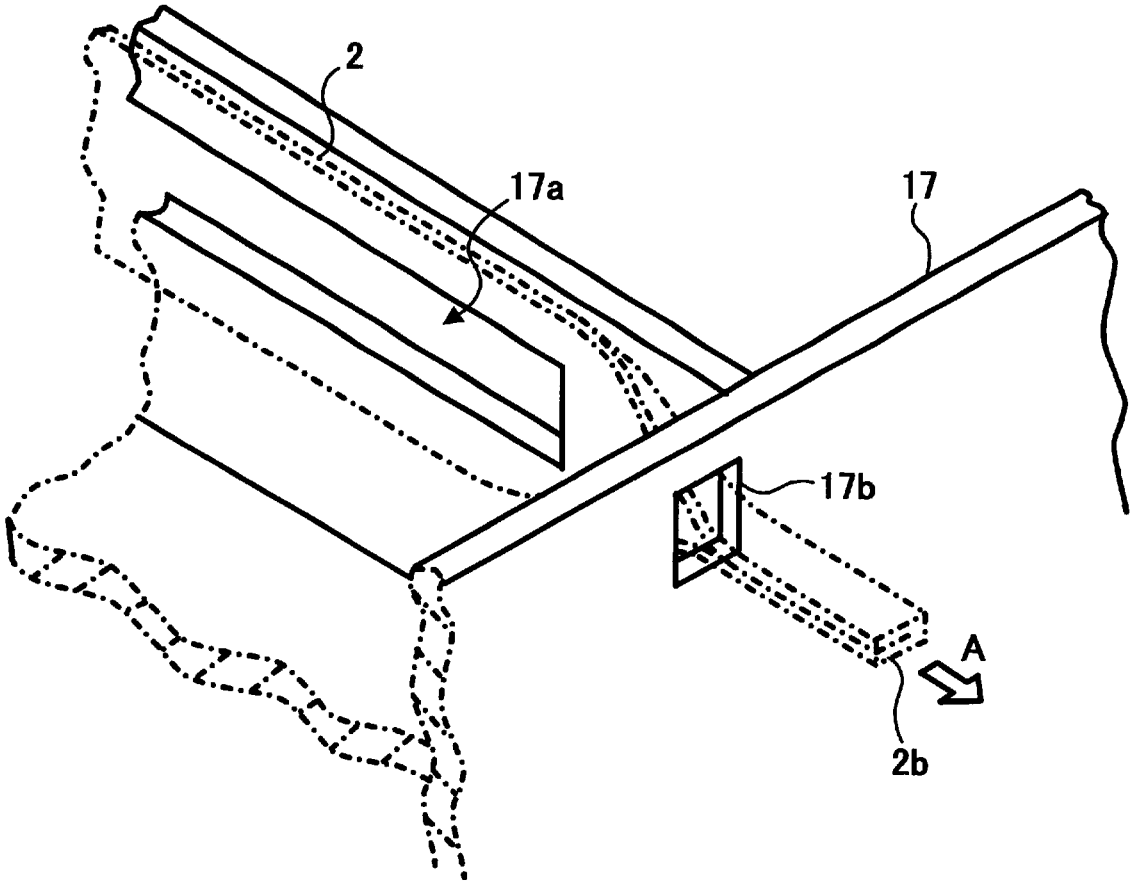
FIG. 8 is a perspective view showing a construction of a main part of a developing container and a leader of a sealing member.
Figure 9:
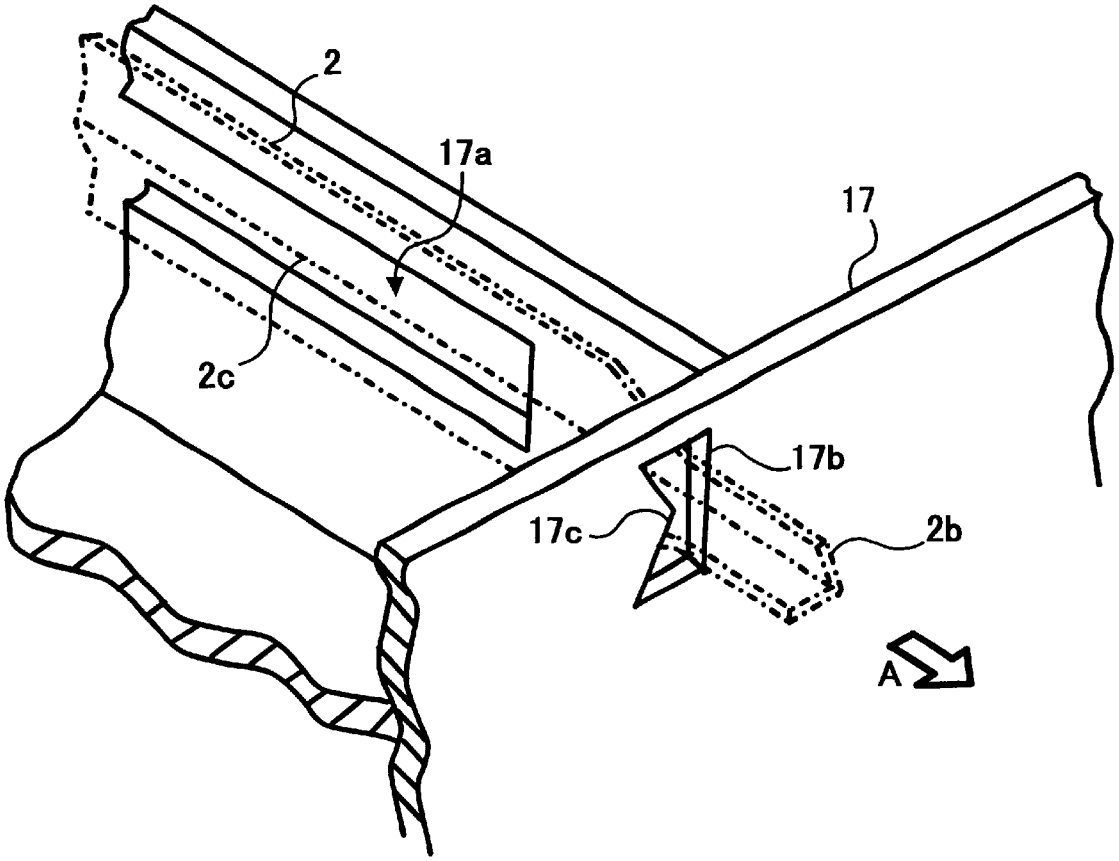
FIG. 9 is a perspective view showing another construction of a main part of a developer container and a leader of a sealing member.

As shown in FIGS. 8 and 9, the leader 2*b* of the sealing member 2 is extended outwards from the housing 17 by being inserted through a seal taking-out hole 17*b*, corresponding to the seal guide hole 3, mounted on a side wall of the developing section 17X of the housing 17, see also FIGS. 6 and 7.

The seal taking-out holes 17*b* shown in FIGS. 6 and 8 illustrate examples in which a measure of each of length "a" and a width "b" is made smaller than the width of the aforementioned sealing member 2, being formed into a rectangular shape so that the sealing member 2 can easily be folded. In addition, the seal taking-out holes 17*b* shown in FIGS. 7 and 9 are examples in which a convex portion of rectangular shape (FIG. 7) or a chevron shape 17*c* (FIG. 9) is formed at a position in a length of one half of the width of the sealing member 2 so that the sealing member 2 is folded similarly to the seal guide hole 3, utilizing the convex portion 17*c*.

The sealing member 2 shown in FIG. 8 is constructed with the leader 2*b* adhering to an inside of the crease formed at a tip end portion thereof, as shown in FIG. 2B, and another sealing member 2 shown in FIG. 9 is constructed with a crease 2*c* formed along the direction in which the sealing member 2 is unsealed, as shown in FIG. 2A. The shapes of the seal taking-out hole 17*b* and the sealing member 2 are appropriately selected so that the most effective combination is achieved.

Figure 10A:
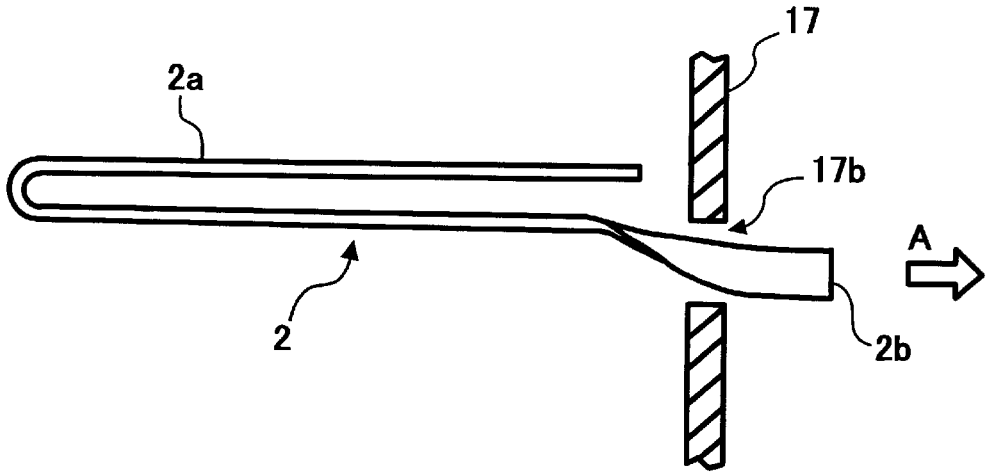
FIG. 10A is a schematic illustration of a sealing member in a state of unsealing the sealing member from the developer container.
Figure 10B:
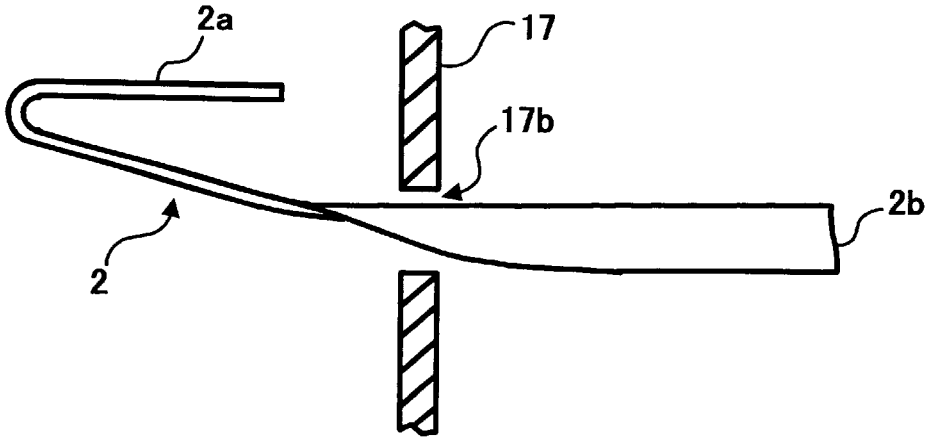
FIG. 10B is a schematic illustration for an unsealing process of a sealing member peeled off from a developer container.
Figure 10C:
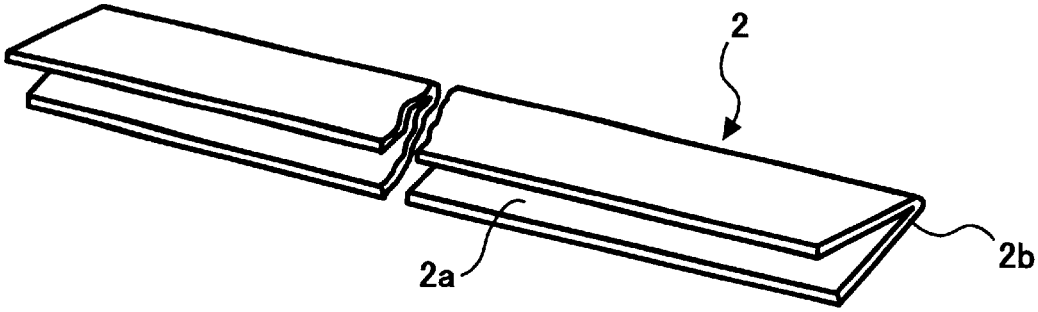
FIG. 10C is a schematic illustration of a sealing member showing a shape after being unsealed from a developer container.

As shown in FIGS. 10A and 10B, when the sealing member 2 is pulled out pinching the leader 2*b* in a direction of unsealing the sealing member 2 indicated by an arrow A in FIG. 10A, the sealing member 2 is formed into a shape in which the sealing-face 2*a* thereof is not externally exposed by folding the sealing member 2 with the sealing-face 2*a* inside, according to a shape of the aforementioned seal taking-out hole 17*b*, as shown in FIG. 10C. Thus, the sealing member 2 of this embodiment of the present invention has the sealing-face 2*a* formed into a shape that is not externally exposed by the operation of unsealing the sealing member 2. Accordingly, when the opening covered by the sealing member 2 is unsealed, and when the sealing member 2 that is removed from the opening 1*a* of the container 1 is thrown away, any contents (the toner 18 contained in the hopper part 17Y, in this case) stuck to the sealing-face are scarcely externally exposed from the sealing member 2. Therefore, the toner 18 is prevented from sticking to an operator's hands, clothing, and the like.

On the other hand, if the sealing member 2 on the toner-supplying outlet 17*a* is unsealed by pulling out the sealing member 2 from the aforementioned seal taking-out hole 17*b*, the toner 18 contained in the hopper part 17Y is supplied to the developing section 17X after being agitated and conveyed with a rotation of an agitator 19. The toner 18 supplied to the developing section 17X is then conveyed to the developing roller 14, either by magnetic force when the toner 18 is a magnetizable toner, or by a mechanical device or the like when the toner 18 is a non-magnetizable toner. The toner 18 supplied to the developing roller 14 is friction-charged to a predetermined polarity by a developing doctor blade 20 as a thin-layer making device by a rotation of the developing roller 14, and is then conveyed to a photoconductive drum 11 to be formed into a thin layer of an approximately uniform thickness. The toner 18 conveyed to the photoconductive drum 11 is then transferred onto a transfer paper (not shown) after the electrostatic latent image on the photoconductive drum 11 is developed to a visible image by an image forming process of an electrophotographic method, and the toner is then fixed on the transfer paper as a copied image with a fixing device (not shown).

On the other hand, a maximum measure of the seal taking-out hole 17*b* formed at a side of the housing 17 of the aforementioned process cartridge has been formed larger than a width of the rectangular sealing part to the direction of unsealing the sealing member 2 so that the sealing member 2 can be pulled out with an allowance.

Figure 11:
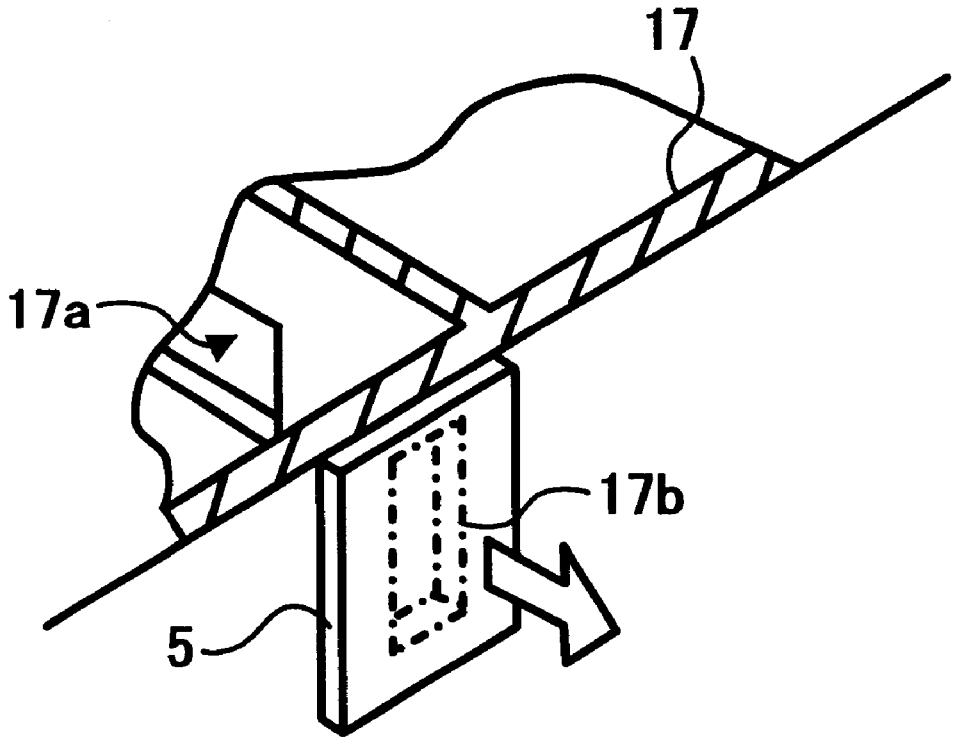
FIG. 11 is a schematic perspective view of a seal taking-out hole sealing member adhered to a seal taking-out hole of a developing device.

The seal taking-out hole 17*b* is incorporated with the hopper part 17Y in a state of opening the toner-supplying 17*a* of the hopper part 17Y by unsealing the sealing member 2. In this kind of process cartridge, if the seal taking out hole 17*b* is kept opened, the toner 18 contained in the hopper part 17Y flows out through the seal taking out hole 17*b* formed at a side of the housing 17 of the process cartridge. In this kind of process cartridge, the seal taking-out hole 17*b* is unsealed with a taking-out hole sealing member 5 as another sealing member, as shown in FIG. 11, after the toner-supplying outlet 17*a* of the hopper part 17Y is unsealed by pulling out the sealing member through the seal taking-out hole 17*a*, so that the toner 18 is prevented from flowing out from the seal taking-out hole 17*b*.

In this type of a process cartridge, if the seal taking-out hole 17*b* is left open, the toner 18 contained in the hopper part 17Y may flow out through the seal taking-out hole 17*b* formed at the side of the housing 17 of the process cartridge. In this type of a process cartridge, for example, the seal taking-out hole 17*b* is sealed with a taking-out hole sealing member 5 as another sealing member as shown in FIG. 11 after the sealing member is pulled out through the seal taking-out hole 17*b* and the toner-supplying outlet 17*a* of the hopper part 17Y is opened, so that the toner 18 is prevented from flowing out from the seal taking-out hole 17*b*. However, if the seal taking-out hole 17*b* is relatively large, there is a problem that a sealing property of the taking-out hole sealing member 5 for sealing the seal taking-out hole 17*b* deteriorates. This is because a pressure of the toner 18 contained in the hopper part 17Y to flow out from the seal taking-out hole 17*b* rises.

In addition, in a case that the shape and the size of the toner-supplying outlet 17*a* are different in each type of process cartridge, the seal taking-out hole 17*b* has a different shape and size individually, corresponding to the shape and the size of the sealing member 2. This is because the shape and the size of the sealing member 2 for sealing the toner-supplying outlet 17*a* are different. Thus, in the preceding process cartridge, there is a problem that the selection of the seal taking-out hole sealing member 5 becomes complicated, since seal taking-out hole sealing members 5 having an individually different shape and size are required to be prepared, corresponding to the shape and the size of the seal taking-out hole 17*b*.

In the process cartridge and the toner cartridge (hereinafter referred to as a "cartridge" as a generic word) as a container relevant to the present invention, a maximum size of the aforementioned seal taking-out hole 17*b* is constructed to be smaller than a width of the sealing part rectangular to the direction for unsealing the sealing member 2.

Figure 12A:
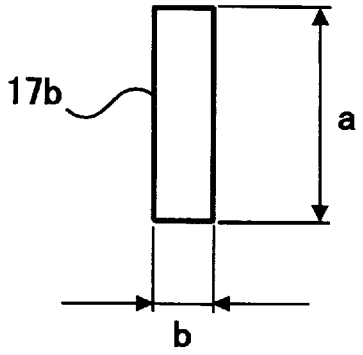
FIGS. 12A, 12B and 12C are schematic illustrations of a maximum desirable size of a seal taking-out hole.
Figure 12B:
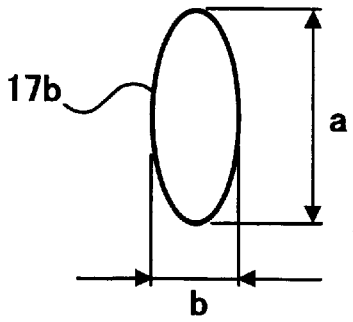
Figure 12C:
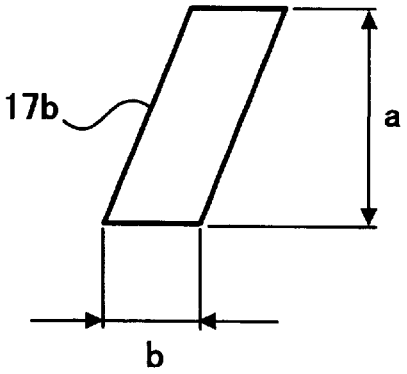

For example, in a case that the shape of the seal taking-out hole is rectangular, as shown in FIG. 12A, the maximum size of the aforementioned seal taking-out hole 17*b* is the long side "a", and in a case that the shape of the seal taking-out hole is elliptic, the maximum size of the aforementioned seal taking-out hole 17*b* is a measure "a" of the long axis. Further, in a case that the shape of the seal taking-out hole is a parallelogram, the maximum size of the aforementioned seal taking-out hole 17*b* is a height "a" of the long side.

Figure 13:
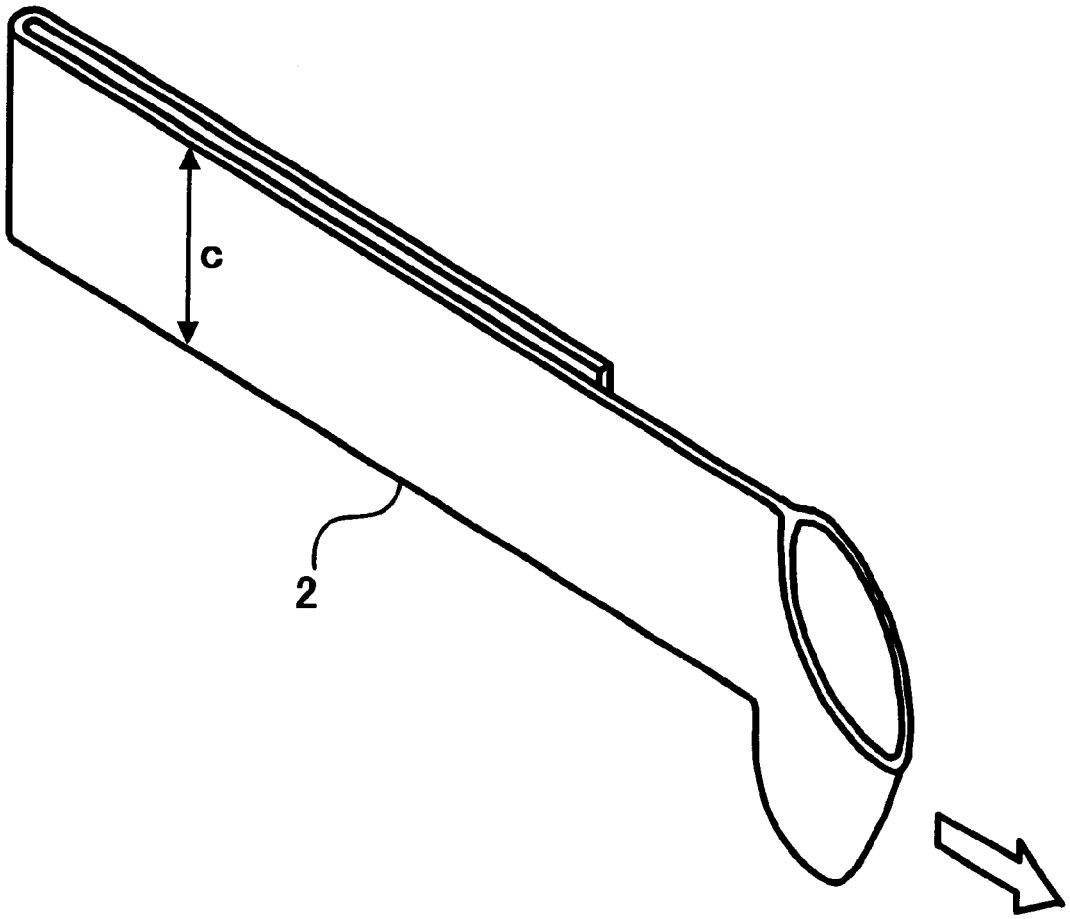
FIG. 13 is a schematic perspective view of a sealing member indicating a maximum desirable size of a seal taking-out hole.

With reference also to FIG. 13, by forming the maximum size "a" of the seal taking-out hole 17*b* to be smaller than the width "c" of the sealing part that is rectangular to the direction for unsealing the sealing member 2, the pressure of the toner 18 contained in the cartridge that is to flow out from the seal taking-out hole 17*b* is lowered, and the sealing property of the seal taking-out hole sealing member 5 is improved as a sealing member for sealing the seal taking-out hole 17*b*.

Even though the shape and the size of the toner supplying outlet 17*a* are slightly different in this cartridge, the shape and the size of the seal taking-out hole 17*b* of the cartridge can approximately be uniform. Accordingly, the selection of the seal taking-out hole 5 becomes easy.

Figure 14A:
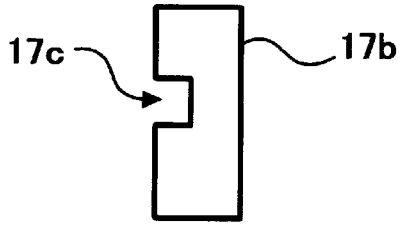
FIGS. 14A, 14B and 14C are schematic illustrations of a convex portion provided at a seal taking-out hole.
Figure 14B:
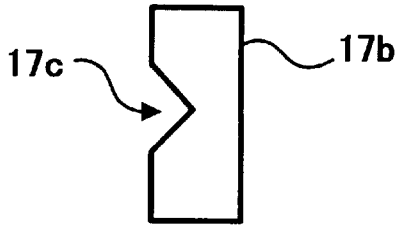
Figure 14C:
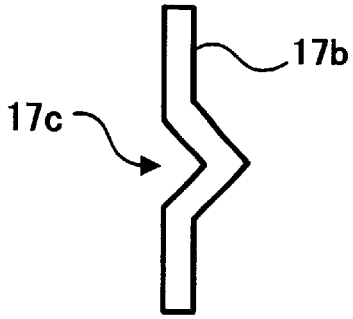

With reference to FIG. 7, the convex portion 17*c* is formed on the seal taking-out hole 17*b* in the cartridge such that the face of the sealing member 2 can be bent. Thereby, the convex portion 17*c* on the seal taking-out hole 17*b* can bend the sealing member 2 when the sealing member 2 is pulled out from the seal taking-out hole 17*b*. Therefore, if the convex portion 17*c* is in a rectangular shape or a triangular shape as shown in, for example, FIGS. 14A, 14B, and 14C, and is mounted on a predetermined position in the seal taking-out hole 17*b* with the opening sealing-face inside (the face at a side for sealing the toner-supplying outlet 17*a*) so that the sealing member 2 is bent, the sealing member 2 can be folded with the opening sealing-face inside. Thereby, an operator's hands, clothing, and the like, can be prevented from being dirtied from any toner 18 that is stuck on the opening sealing-face of the sealing member 2 after the sealing member 2 is unsealed.

Figure 15:
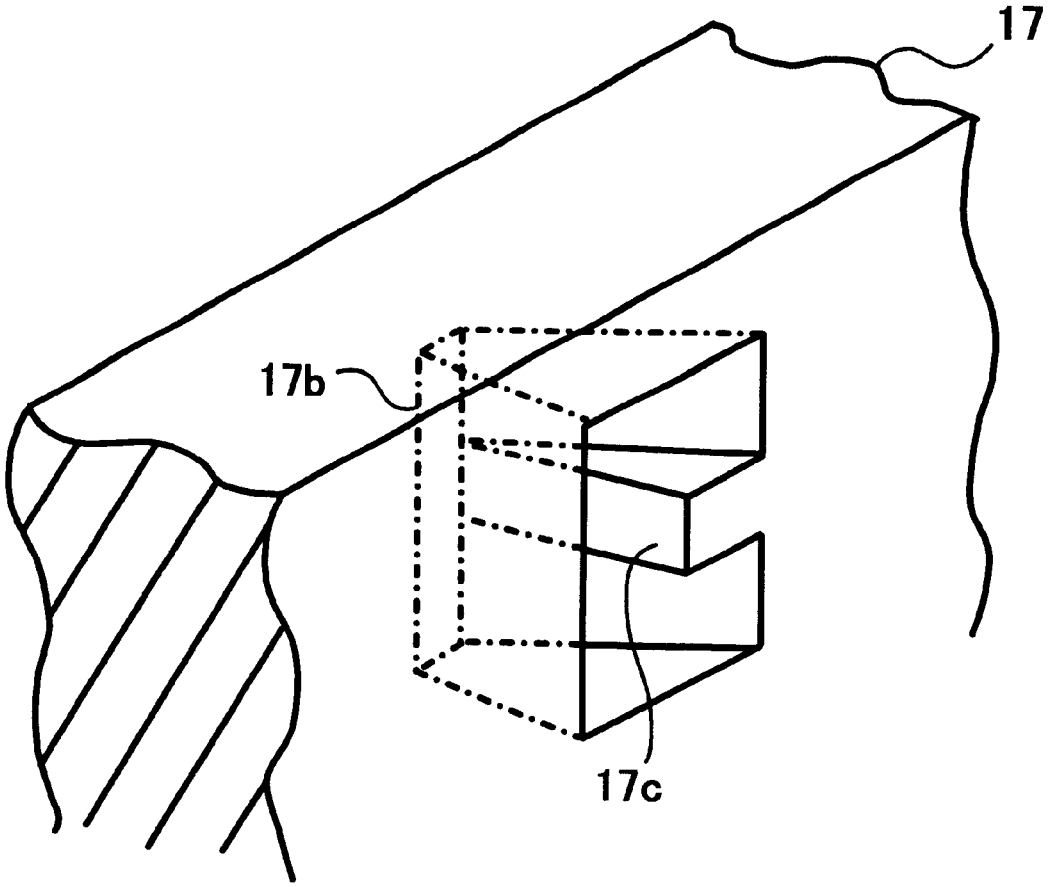
FIG. 15 is a schematic perspective view showing an example of a shape of a convex portion mounted on a seal taking-out hole.

The size of the seal taking-out hole 17*b* at a position outside the housing of the cartridge can be made small by forming the convex portion 17*c* so that, for example, only the inside portion (the side where the toner 18 is contained) of the housing 17 of the cartridge projects, as shown in FIG. 15. Therefore, the size of the seal taking-out hole 17*b* cannot be made large on the basis of forming the convex portion 17*c*.

Still another embodiment of the present invention will be described, which is applied, as an example, to a sealing member for sealing an opening for supplying developer in a developing container that contains the developer including at least the toner 18, at the developing device of an image forming apparatus.

Figure 16:
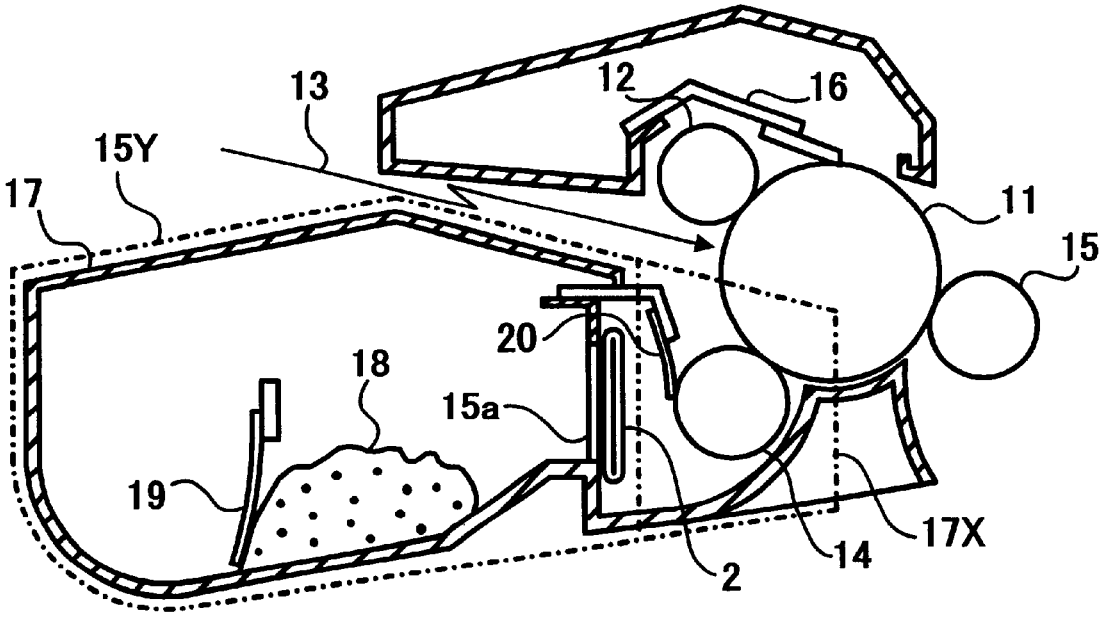
FIG. 16 is an elevation showing a schematic construction of a process cartridge having another sealing member of the present invention.

FIG. 16 is an illustration showing a schematic construction of an example of a cartridge of an image forming apparatus. In FIG. 16, the image forming apparatus includes a photoconductive drum 11 as a latent image bearing member, a charging roller 12 as a charging device, a light 13 for optical writing of an exposing device (not shown), a developing roller 14 as a developing device, a transfer roller 15 as a transfer device, and a cleaning blade 16 as a cleaning device.

These devices are disposed in the housing 17 of the cartridge respectively, and a developing section 17X and a hopper part 17Y as a developer container are formed into the housing 17. Further, at a wall part of a boundary of the housing 17 between the developing device 17X and the hopper part 17Y, the toner-supplying outlet 17*a* as an opening is formed. A sealing member 2A is mounted on the toner-supplying outlet 17*a*.

Figure 17A:
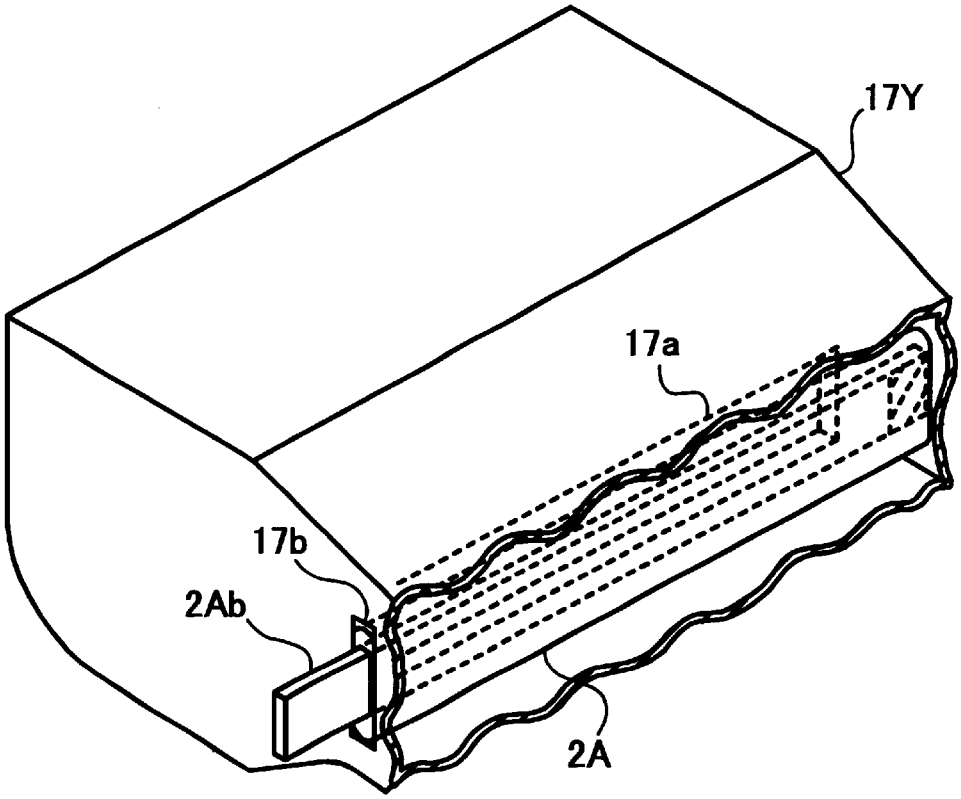
FIGS. 17A and 17B are explanatory views of a sealing member.

As shown in FIG. 17A, the toner-supplying outlet 17*a* is sealed with the sealing member 2A by heat melting adhesion or another adhesion so that the toner 18 in the hopper part 17Y in an unused cartridge is prevented from flowing out towards the developing section 17X after the toner 18 is contained in the hopper part 17Y, namely, a toner scattering from the cartridge is prevented. The sealing member 2A is peeled off from the toner-supplying outlet 17*a* after the cartridge is set to the usable state.

The aforementioned sealing member 2A is formed into a flat shape with pressure from a member which originally has a cylindrical shape made of a flexible film. Two faces are made from parts corresponding to an outer peripheral face of the cylindrical member as a result, and one of the faces is used for a sealing-face 2A*a* and the other face is used for a cover face. Further, an inside part of the sealing member 2A, i.e., an end of a leader 2A*b* for pinching when the operator pulls out the sealing member 2A, is adhered to an end portion in a longitudinal direction of a part which corresponds to an inner peripheral face of the cylindrical sealing member 2A. A hatched portion in FIG. 17A is where the leader 2A*b* is adhered to the sealing member 2A. Another end of the leader 2A*b* extends outside of the sealing member 2A passing through the inner side of the sealing member 2A. The leader 2A*b* of the sealing member 2A extends to the outside of the housing 17 passing through the seal taking-out hole 17*b* that is formed on the side wall of the developing section 17X of the housing 17.

Any material can be employed for the sealing member 2, and a high quality paper, Mylar (Polyester film), PET film, or the like material, for example, which has a good adhesive property to the container 1 and tensile strength sufficient to withstand a tension caused by peeling of the sealing member 2 is more preferable.

Figure 17B:
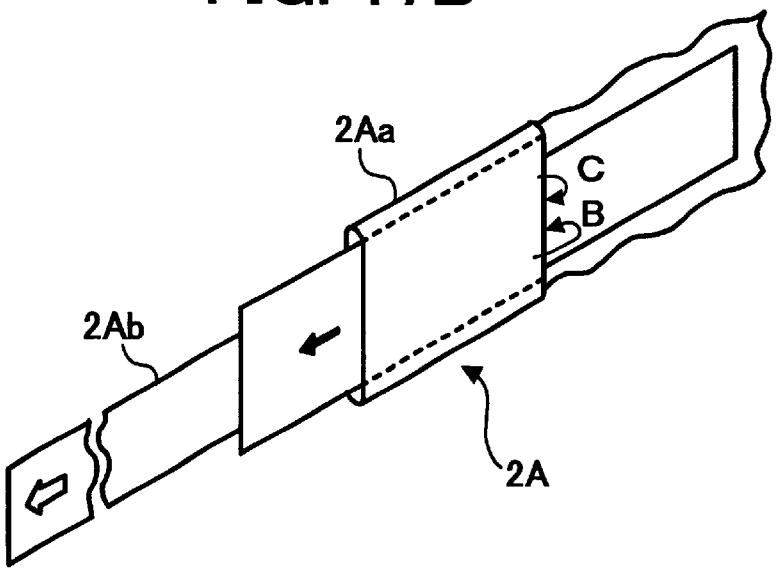

Further, as shown in FIG. 17B, when the operator pulls out the sealing member 2A in the direction indicated by a white arrow while pinching the leader 2A*b* of the sealing member 2A, an outer face of the sealing member 2A enters an inside of the sealing member 2A as indicated by arrows B and C in FIG. 17B from an end where the leader 2A*b* is adhered, while the outer face and the inner face of the cylindrical sealing member are reversed. Thereby, by the unsealing operation for the opening from the end portion thereof, the sealing-face 2A*a* that originally faced the toner 18 at a time when the opening is sealed is changed to an inner face. Then, the sealing member 2A is formed into a shape in which the sealing-face 2A*a* is not externally exposed.

The sealing-face 2A*a* is thus changed to the inner face by the unsealing operation for the sealing member 2A, and the sealing member 2A of the present invention is formed into a shape that its sealing face 2A*a* is not externally exposed. Accordingly, the contents stuck to the sealing face 2A*a* (the toner 18 contained in the hopper part 17Y) are scarcely externally exposed when the sealing member 2A on the opening is unsealed and when the sealing member 2A that is removed from the toner-supplying outlet 17*a* is thrown away. Therefore, the toner 18 is prevented from sticking to the hands, clothing, and the like, of an operator.

Since the sealing member 2A has a cylindrical shape, the sealing member 2A does not tend to be reversed again after the reversing operation is performed as mentioned above. Accordingly, the shape of the sealing-face 2A*a* that is not externally exposed can easily be maintained to be covered with the covering face. Thereby, the contents stuck to the sealing-face 2A*a* can further be prevented from contacting the hands, clothing, and the like, of an operator when the sealing member 2A is unsealed, and when the sealing member 2A that is removed from the opening of the container is thrown away.

On the other hand, when the sealing member 2A is pulled out from the seal taking-out hole 17*b* and the sealing member 2A on the toner-supplying outlet 17*a* is unsealed, the toner 18 contained in the hopper 17Y is supplied into the developing section 17X to be agitated and conveyed by a rotation of an agitator 19.

Next, a method of fixing the aforementioned sealing member 2A to the hopper part 17Y is described.

If the leader 2A*b* is previously adhered to the sealing member 2A and then the sealing member 2A is adhered or adhered with melting to the hopper part 17Y, two steps of the process are separately required for producing the sealing member 2A. One step is to adhere the leader 2A*b* to the sealing member 2A, and the other step is to adhere the sealing member 2A to the hopper part 17Y. Therefore, manufacturing costs may rise due to an increase of the number of steps of the process.

Figure 18A:
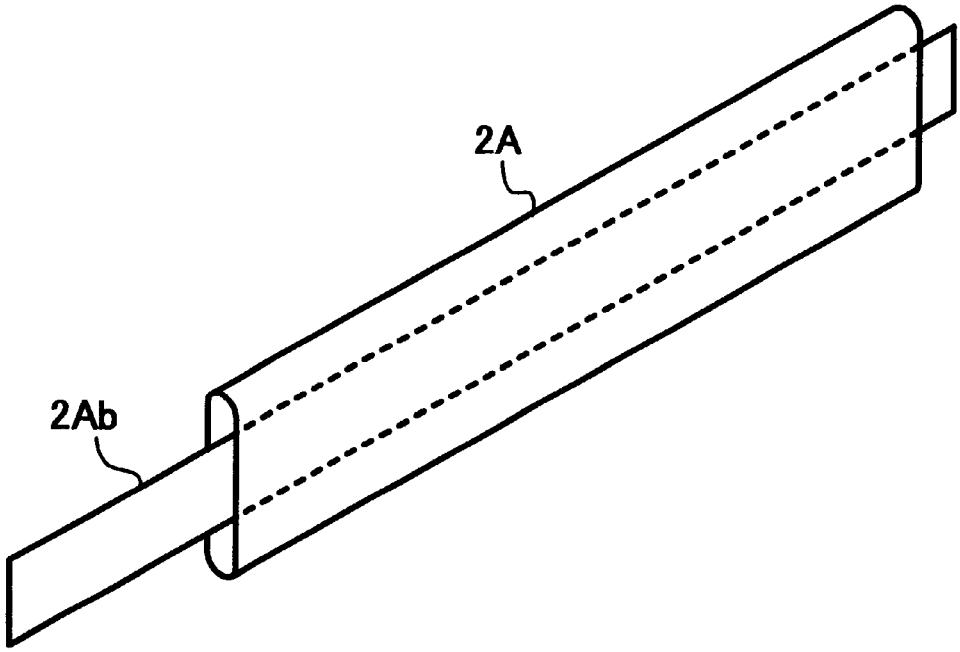
FIGS. 18A and 18B are illustrations for a method for fixing a sealing member onto a hopper part.
Figure 18B:
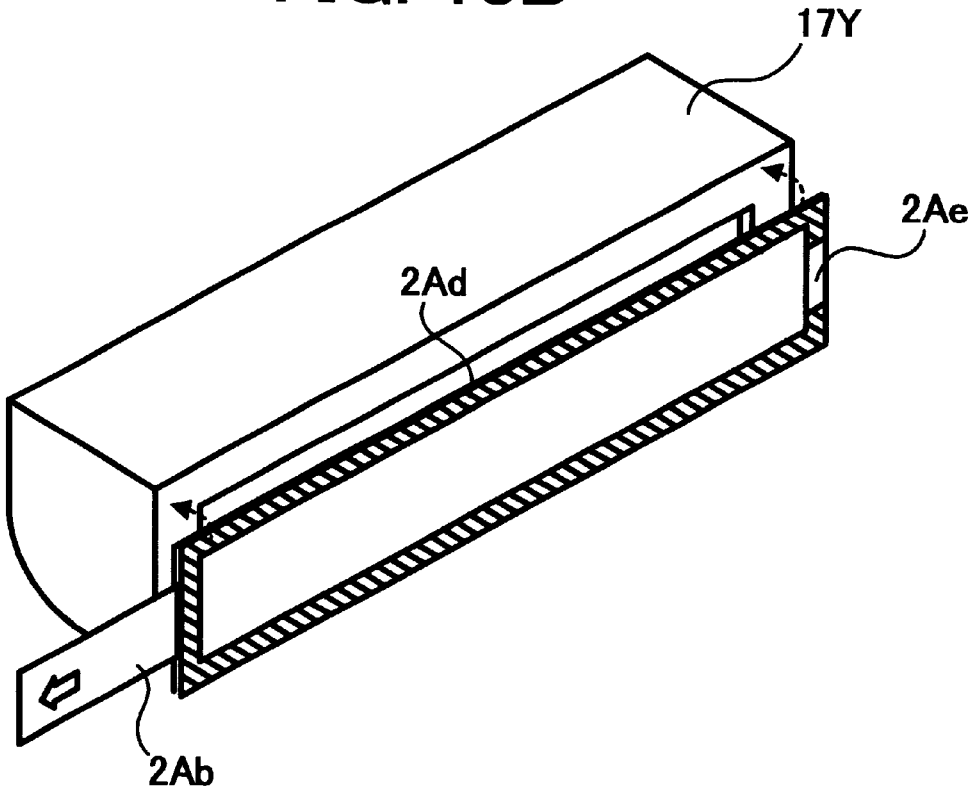

As to the hopper part 17Y relevant to the present invention, the adhesion of the leader 2A*b* to the sealing member 2A can be performed at a same time with melting adhesion or any other adhesion of the sealing member 2A to the hopper 17Y. Specifically, the sealing member 2A with the leader 2A*b* passed through an inside thereof can be squashed into a flat shape as shown in FIG. 18A, and as shown in FIG. 18*b* the leader 2A*b* can be adhered to one end side 2A*e* of the longitudinal direction of the sealing member 2A at an inside thereof at a same time with adhesion of edge portions 2A*d* of the sealing member 2A (which edge portions are hatched in FIG. 18B) facing the hopper part 17Y. Thereby, any increase of the number of steps in the process is suppressed, and the manufacturing costs can be reduced.

In accordance with the aforementioned embodiment, at a time when the unsealing operation for the sealing member 2A on the opening is performed, and when the sealing member 2A removed from the toner-supplying outlet 17*a* of the hopper part 17Y is performed and then thrown away after the unsealing operation for the sealing member 2A, any toner 18 adhering to the sealing-face 2A*a* can be prevented from contacting the hands, clothing, and the like, of an operator. In addition, the sealing member 2A has a quite simple construction and can be manufactured with low costs. Further, in accordance with the embodiment as mentioned above, the sealing-face 2A*a* of the sealing member 2A can easily be made not to be externally exposed by pulling out the sealing member 2A while pinching the leader 2A*b*. Therefore, the operation property is improved.

Furthermore, in accordance with the embodiment as mentioned above, the adhesion of the sealing member 2A to the hopper part 17Y and the adhesion of the leader 2A*b* to the sealing member 2A can be performed at the same time. Therefore, the number of steps of the process required for producing the hopper part can be decreased and manufacturing costs can also be decreased.

The aforementioned embodiments are examples in which the present invention is applied to a sealing member for sealing on opening for supplying developer in a developer container in a developing device of an image forming apparatus. However, the present invention may also be applicable for a sealing member for sealing an opening of a container with other contents.

Next, still another embodiment of the present invention is described, which is applied to still another sealing member for sealing an opening for supplying developer in a developing container that contains developer including at least toner in a developing device in an image forming apparatus, although again other containers can be sealed.

Figure 19:
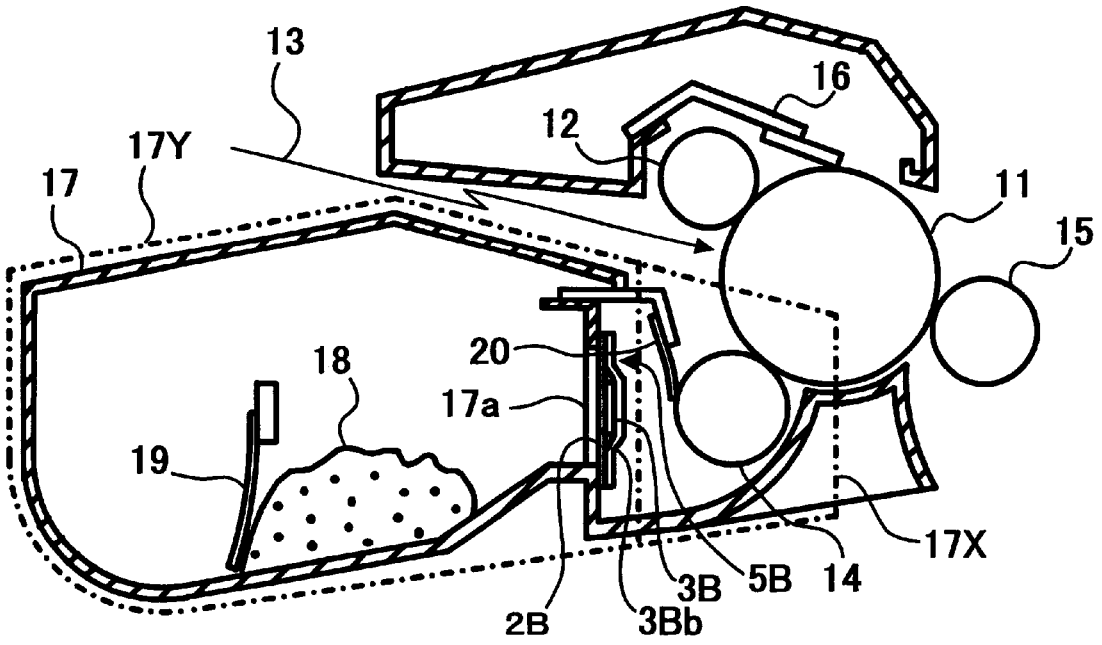
FIG. 19 is an elevation showing a schematic construction of a process cartridge having still another sealing member of the present invention.

FIG. 19 is an illustration showing a schematic construction of an example of a cartridge of the aforementioned image forming apparatus. In FIG. 19, similarly to FIG. 16, the image forming apparatus includes a photoconductive drum 11 as a latent image bearing member, a charging roller 12 as a charging device, a light 13 for optical writing of an exposing device (not shown), a developing roller 14 as a developing device, a transfer roller 15 as a transfer device, and a cleaning blade 16 as a cleaning device. Each device as mentioned above is disposed in the housing of the cartridge, and the developing section 17X and the hopper part 17Y are formed into the housing 17. Further, the toner-supplying outlet 17*a* as an opening is disposed at the boundary of the housing wall between the developing section 17X and the hopper part 17Y of the housing 17.

Figure 20:
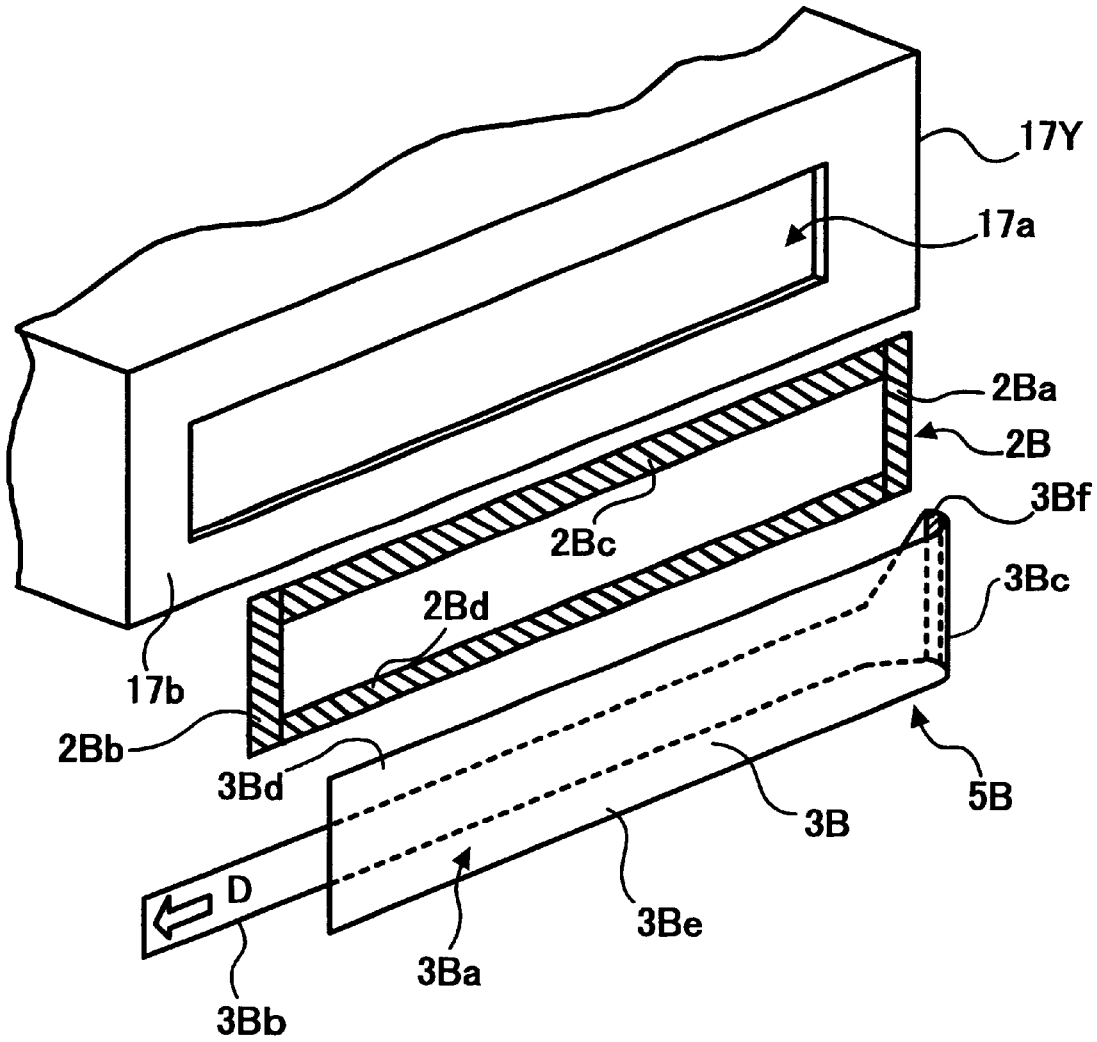
FIG. 20 is an illustration of the hopper part, a lower sheet, and an upper sheet, which compose a sealing member.

FIG. 20 is an illustration of the hopper part and a lower sheet 2B and an upper sheet 3B that composes a sealing member 5B. An edge portion of the toner-supplying outlet 17*a* of the hopper part 17Y is a seal adhesion face 17*b* for adhering to the sealing member. A lower sheet 2B as a lower sealing part of the sealing member is made of a flexible material having an approximately rectangular shape. A part of the lower sheet 2B which, e g., melts and adheres to the seal adhering face 17*b* is composed of a starting edge portion 2B*a* and an ending edge portion 2B*b* at ends of the toner-supplying outlet 17*a* in a longitudinal direction, and two further edge portions 2B*c* and 2B*d* parallel to the aforementioned longitudinal direction. Furthermore, an upper sheet 3B as an upper cover part of the sealing member is also made of a flexible material. The upper sheet 3B includes a rectangular portion 3B*a* having approximately the same shape as the underlying sheet 2B, a leader 3B*b* as an extension part whose width is narrower than the width between the both edge portions 2B*c* and 2B*d* of the underlying sheet 2B, and a connecting portion 3B*c* that connects the rectangular portion 3B*a* and the leader 3B*b*. The aforementioned leader 3B*b* is made longer than the rectangular portion 3B*a* in a longitudinal direction, and the end portion of leader 3B*b* is a pinching portion for pulling out the leader 3B*b* in a direction indicated by an arrow D.

Next, a method of melting/fixing the lower sheet 2B to the hopper part 17Y and a method of fixing the upper sheet 3B to the lower sheet 2B are described hereinbelow referring to FIG. 20. First, the edge portions 2B*a*, 2B*b*, 2B*c*, 2B*d* of the lower sheet 2B are fixed to be capable of being peeled off, e.g., with melting, to the seal adhering face 17*b* of the hopper part 17Y where the toner 18 is contained. Next, the upper and lower edge portions 3B*d*, 3B*e* that are parallel to the lower sheet 2B and a fixing portion 3B*f* are respectively fixed onto the aforementioned edge portions 2B*c*, 2B*d*, and 2B*a* of the lower sheet 2B, while the leader 3B*b* is turned back in a U-like shape at the connecting portion 3B*c* of the upper sheet 3B. Further, an end portion of the leader 3B*b* is projected outside from the lower sheet 2B and an end portion opposing the turning back portion of the upper sheet 3B in a longitudinal direction.

Accordingly, the leader 3B*b* is kept sandwiched between the two sheets of the lower sheet 2B and the upper sheet 3B. The sealing member 5B is composed of the lower sheet 2B and upper sheet 3B thus assembled.

Figure 21:
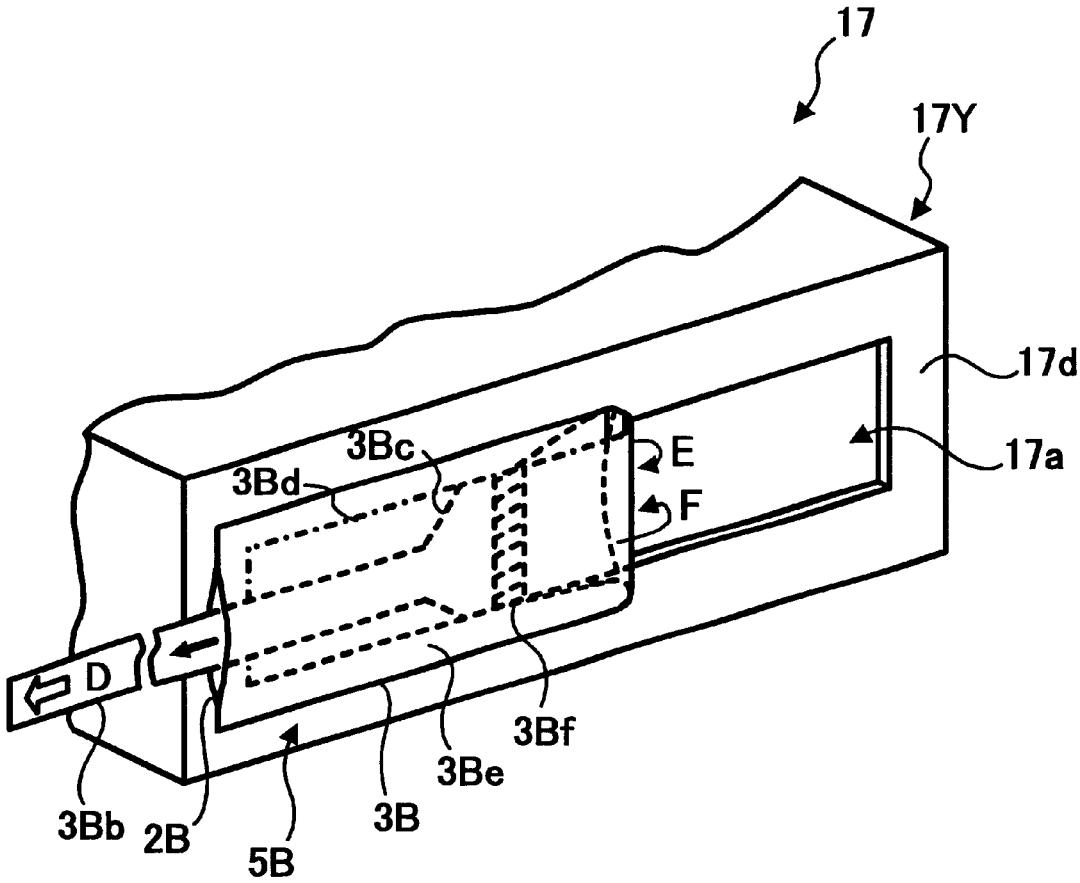
FIG. 21 is an illustration of an unsealing operation of a sealing member from a cartridge.
Figure 22:
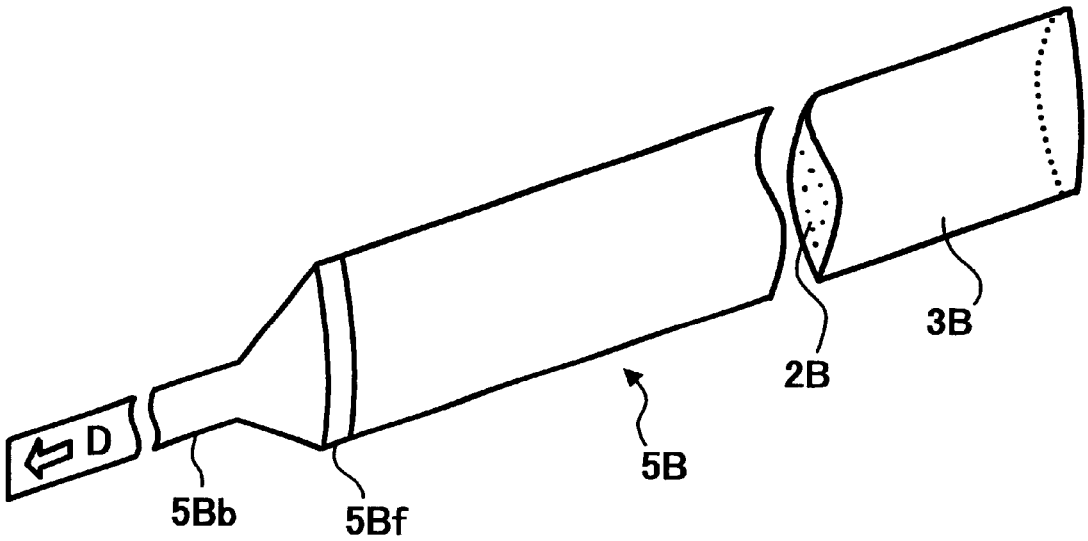
FIG. 22 is an illustration of a state of a sealing member after being peeled off.

A peeling off operation of the sealing member 5B from the hopper part 17Y is described hereinbelow. FIG. 21 is an explanatory view showing the sealing member 5B during the peeling off operation thereof from the hopper part 17Y. FIG. 22 shows the sealing member 5B after being peeled off from the hopper 17Y.

When an end portion of the leader 3B*b* is pulled in a direction indicated by arrow D in FIG. 21 after the cartridge is set in the main body of the image forming apparatus, the fixing portion 3B*f* of the upper sheet 3B and the edge portion 2B*a* of the lower sheet 2B are pulled and are then started to be peeled off from the seal adhesion face 17*d* of the hopper 17Y. Further, the contacting face to the toner 18 as an opening sealing-face of the lower sheet 2B and an outer side face of upper sheet 3B that is not facing the lower sheet 2B then enter an inside of the sealing member 5B, both being reversed in the direction indicated by arrows E and F in FIG. 21, along with the end portion of the leader which is pulled in a direction indicated by the arrow D in FIG. 21.

Furthermore, when the lower sheet 2B is peeled off to the edge portion 2B*b*, and if the end portion of the leader 3B*b* is further pulled in a direction indicated by the arrow D in FIG. 21, the lower sheet 2B passes past the seal adhesion face 17*d*, and the peeling off operation ends. In addition, the faces of the lower sheet 2B and the upper sheet 3B that are not facing each other terminate the reversing operation. Thereby, the contacting face of the lower sheet 2B that contacts the toner 18 is positioned between the lower sheet 2B and upper sheet 3B. Consequently, any toner 18 on the contacting face of lower sheet 2B is prevented from sticking to an operator's hands, clothing, and the like, and the scattering of the toner 18 is prevented when the sealing member 5B is thrown away.

Further, in the aforementioned embodiment, the sealing member 5B is composed of two sheets. However, the sealing member can be composed of three or more than three sheets. Thereby, the sealing member can be further strengthened.

Further, in the sealing member 2A shown in FIGS. 16 through 18, or the sealing member 5B shown in FIGS. 19 through 22, there is a strong possibility that any remaining toner 18 inside of the sealing member 2A (or 5B) will spill out from the opening of a terminal portion of the sealing member 2A (or 5B) after the sealing member 2A (or 5B) is completely pulled out, because the toner 18 comes to a state at an inner part of the cylindrical shape of the sealing member 2A (or 5B) whose surface is reversed when the cylindrical sealing member 2A (or 5B) is pulled out from the toner-supplying outlet 17*a* on the hopper part 17Y, even though the toner 18 is prevented from dirtying an operator's hands and clothing in a pulling out process of the sealing member 2A (or 5B). Therefore, when the sealing member 2A (or 5B) is used as shown, for example, in FIG. 23, an adhesive agent layer 6 that seals the sealing member 2A (or 5B) adhering the terminal portion thereof can be provided at the terminal portion of the sealing member 2A (or 5B) to be peeled off from the toner-supplying outlet 17*a* of the hopper part 17Y. This adhesive agent 6 can be made of a double-faced adhesive tape.

Figure 23A:
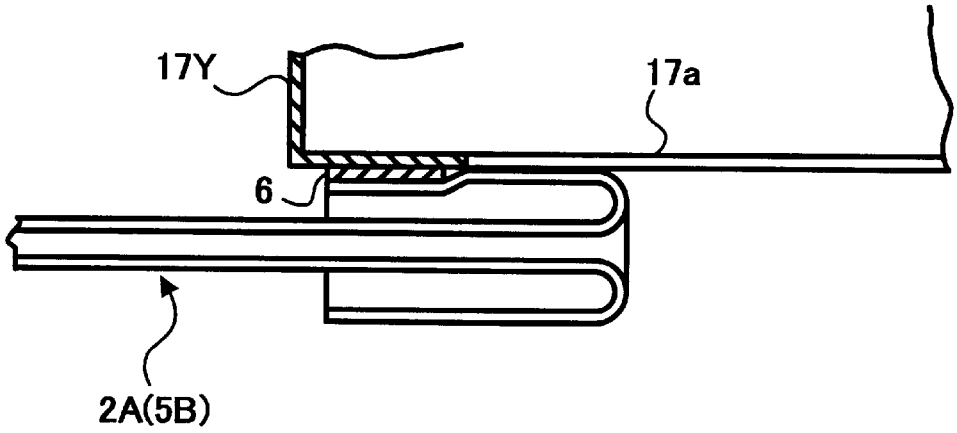
FIGS. 23A, 23B and 23C are schematic cross-sections illustrating an unsealing process of a sealing member.
Figure 23B:
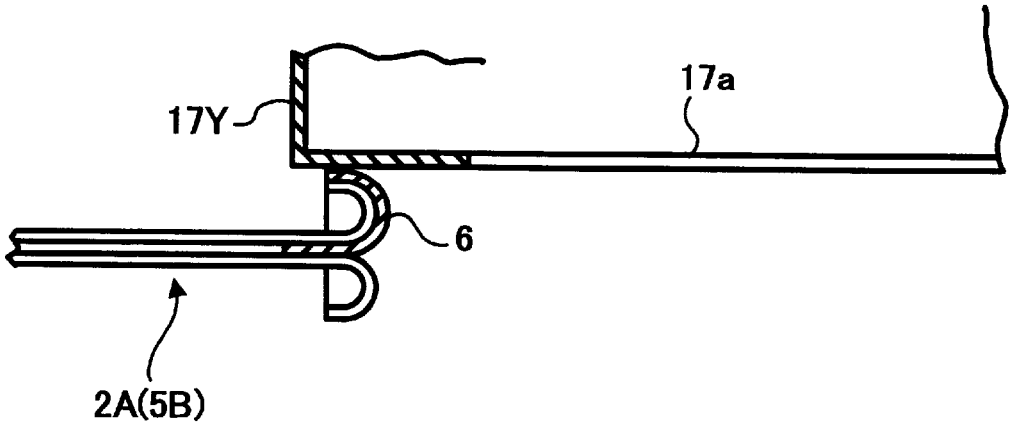
Figure 23C:
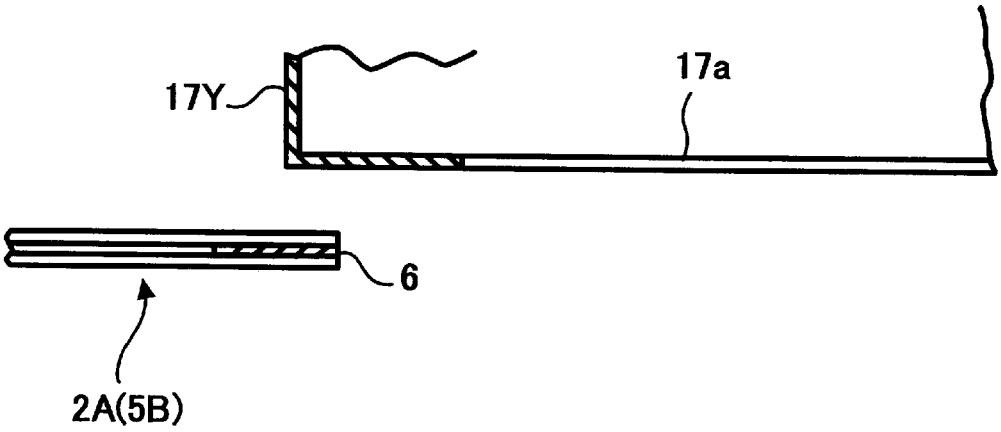

In the sealing member 2A (or 5B), along with the peeling off operation of the sealing member 2A (or 5B) from the toner-supplying outlet 17*a* in the hopper part 17Y as shown in FIGS. 23A and 23B, the opening sealing-face of the sealing member 2A (or 5B) enters between the sealing member 2A (or 5B) and a cover member in accordance with the reversing operation for both of these members. Further, at a time point when peeling off of the sealing member 2A (or 5B) is finished, the terminal portion of the sealing member 2A (or 5B) is adhered to the adhesive agent 6 such that the opening sealing-face enters an inside of the sealing member 2A (or 5B) being reversed, as shown in FIG. 23C. Thereby, the toner 18 stuck to the opening sealing-face is sealed in the sealing member 2A (or 5B). Accordingly, the toner 18 is not scattered, and the operator's hands, clothing, and the like are not contaminated.

The adhesive agent layer 6 can serve as a tentative fixing device at a time when toner-supplying outlet 17*a* of the hopper part 17Y is sealed with the sealing member 2A (5B). Accordingly, the sealing operation for sealing the toner-supplying outlet 17*a* with the sealing member 2A (or 5B) can be easily performed.

Figure 24:
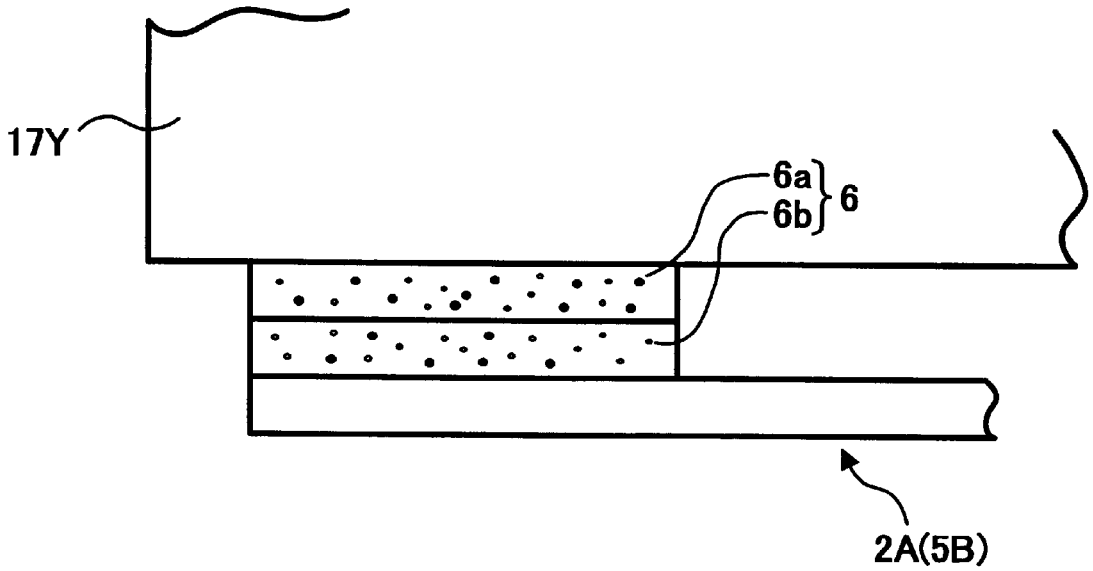
FIG. 24 is an illustration of an adhesive layer formed in a terminal portion of a sealing member.

Further, the adhesive agent layer 6 preferably retains an adhesive property that adheres to the sealing member 2A (or 5B) without losing the adhesive property when the sealing member 2A (or 5B) is peeled off from the toner-supplying outlet 17*a* of the hopper part 17Y. Namely, as shown in FIG. 24, the adhesive force of this adhesive agent layer 6 is preferably composed of an adhesive force 6*a* at a side that contacts the hopper part 17Y and an adhesive force 6*b* at a side that contacts the sealing member 2A (or 5B), which is stronger than the adhesive force 6*a*.

Figure 25:
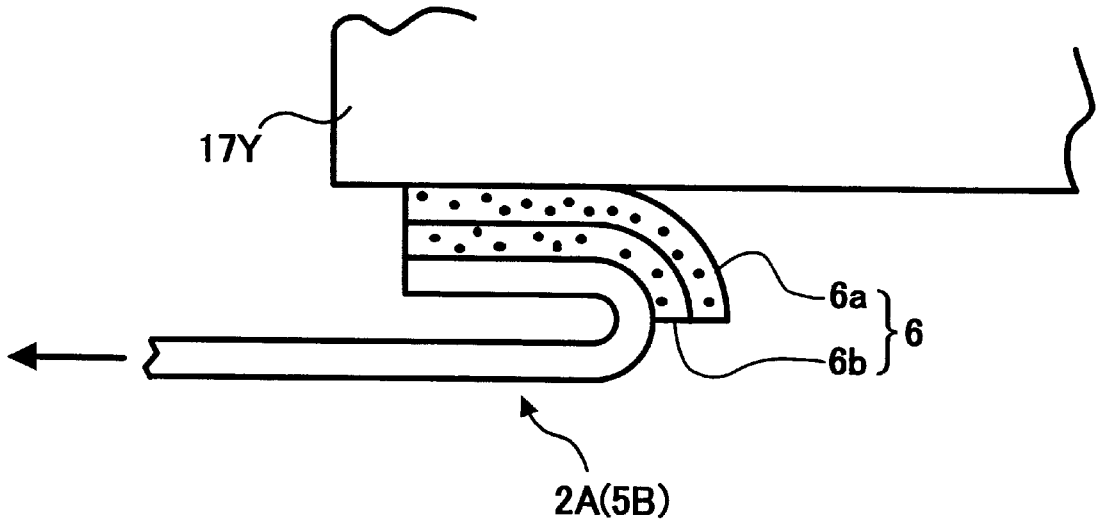
FIG. 25 is an illustration of a good state of a peeling off process of an adhesive layer formed at a terminal portion of a sealing member.
Figure 26:
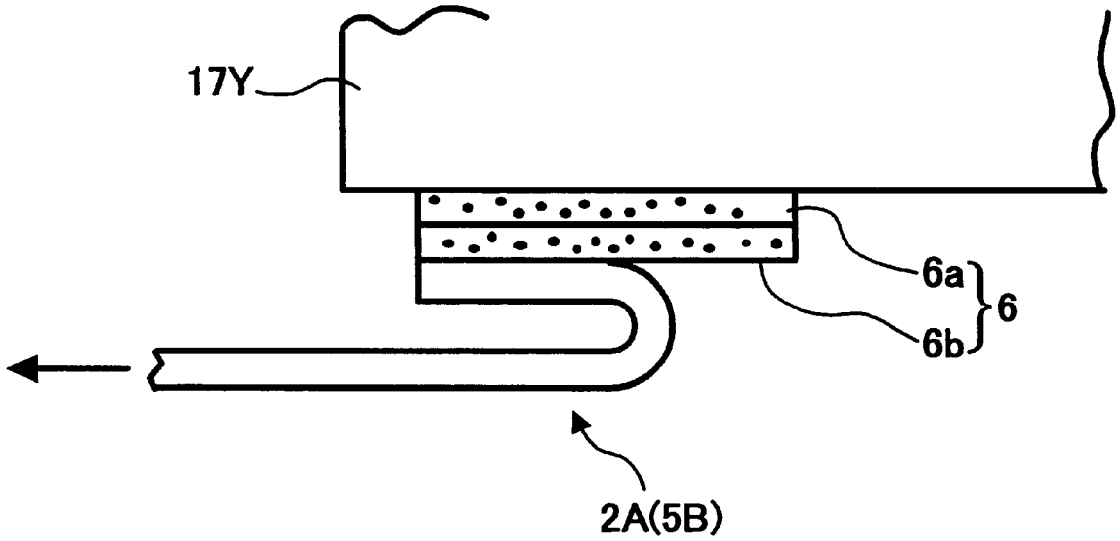
FIG. 26 is an illustration of a bad state of a peeling off process of an adhesive layer formed at a terminal portion of a sealing member.

As shown in FIG. 25, at the sealing member 2A (or 5B) with the adhesive force of the adhesive agent layer 6 thus set, since the adhesive agent layer 6 keeps the adhesive force that adheres to the sealing member 2A (or 5B) without losing the adhesive property in a state of the sealing member 2A (5B) being peeled off from the toner-supplying outlet 17*a* of the hopper part 17Y, the adhesive agent layer 6 can securely be adhered to the sealing member 2A (or 5B), and the terminal portion of the sealing member 2A (or 5B) can securely be adhered to the adhesive agent layer 6 when the sealing member 2A (or 5B) is peeled off from the hopper part 17Y. That is, and as shown in FIG. 26, if the adhesive force 6*a* of the adhesive agent layer 6 at a side contacting the hopper 17Y is set stronger than the adhesive force 6*b* of the adhesive agent layer 6 at a side contacting the sealing member 2A (or 5B), the adhesive agent layer 6 is adhered to the side of the hopper part 17Y when the sealing member 2A (or 5B) is peeled off from the hopper part 17Y. Therefore, the terminal portion of the sealing member 2A (or 5B) cannot adhere to the adhesive agent layer 6.

Figure 27:
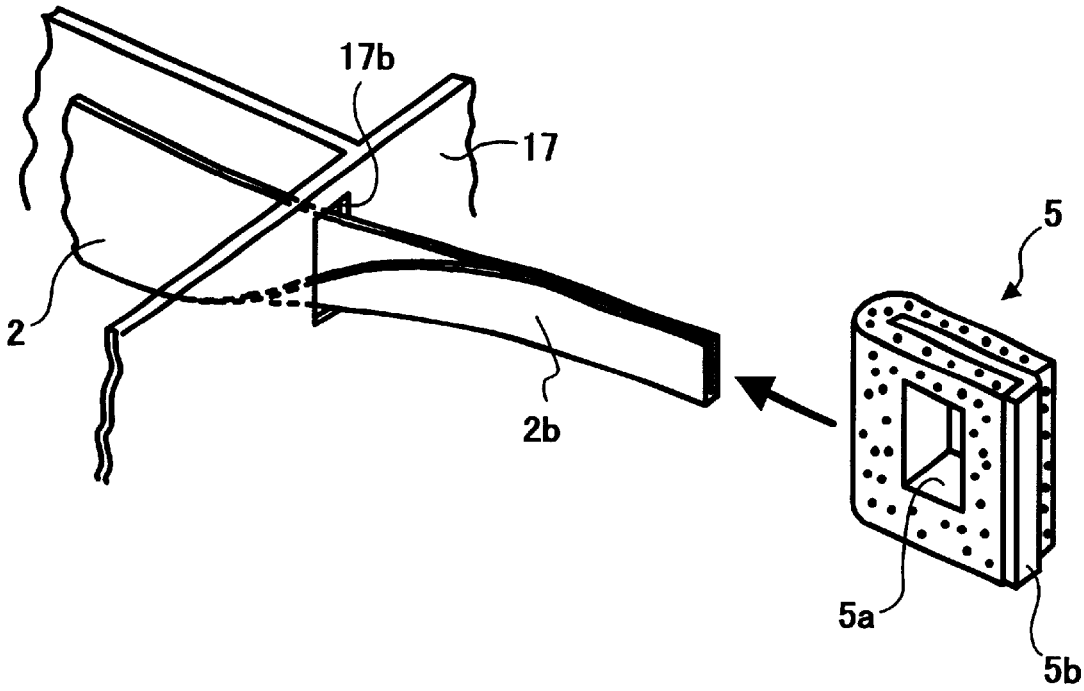
FIG. 27 is a schematic perspective view showing a taking-out hole sealing member which is mounted at a seal taking-out hole of a developing device.
Figure 28:
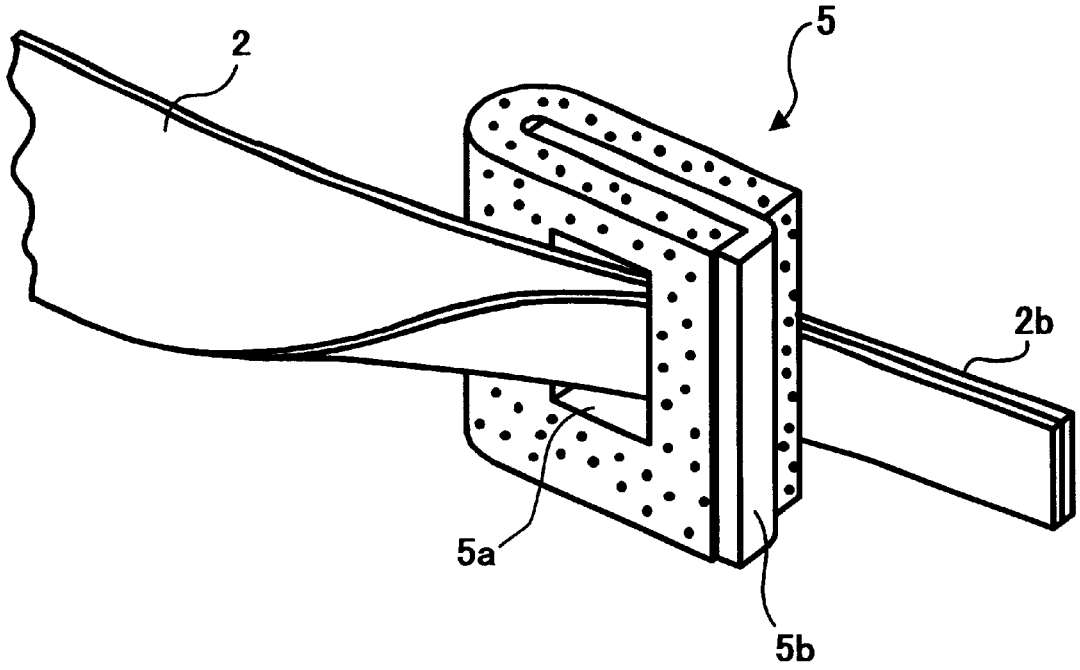
FIG. 28 is a schematic perspective view showing an inserted state of a sealing member through a seal taking-out hole sealing member.
Figure 29:
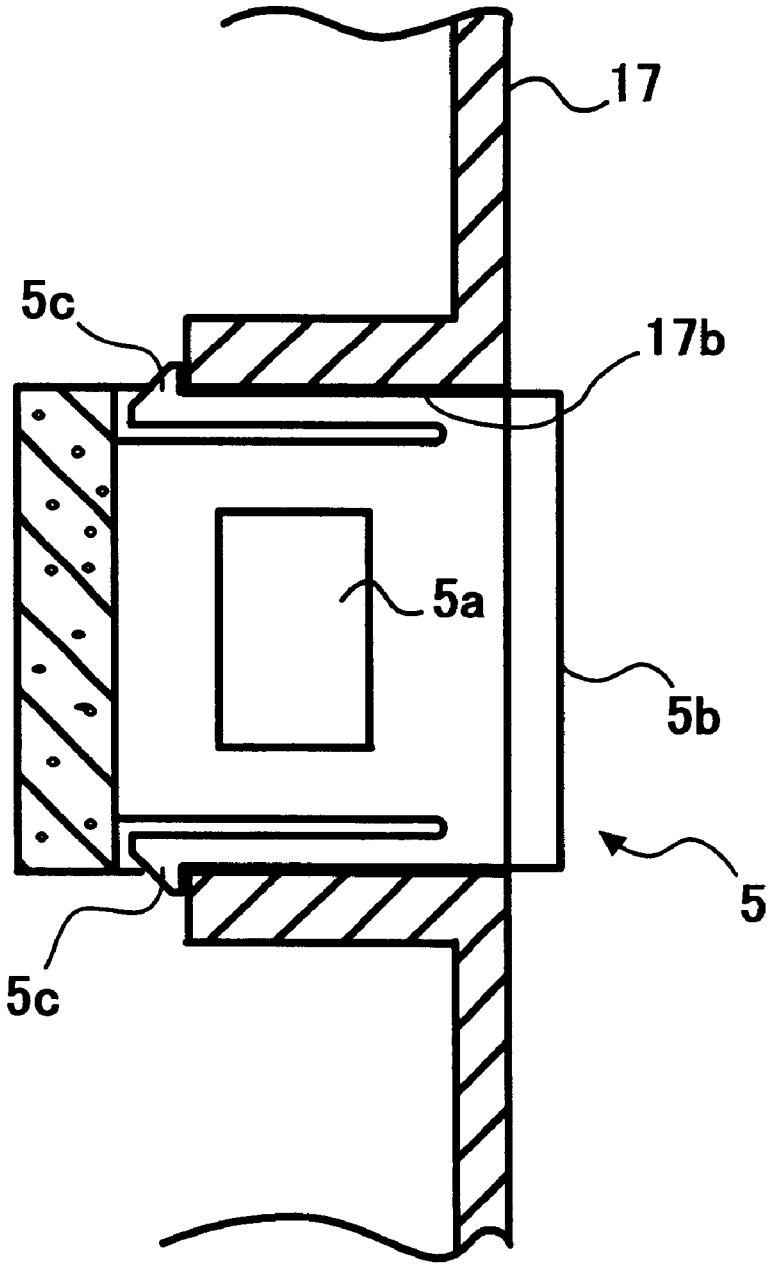
FIG. 29 is a schematic cross-section showing a state of mounting a taking-out hole sealing member on a seal taking-out hole of a developer container.
Figure 30:
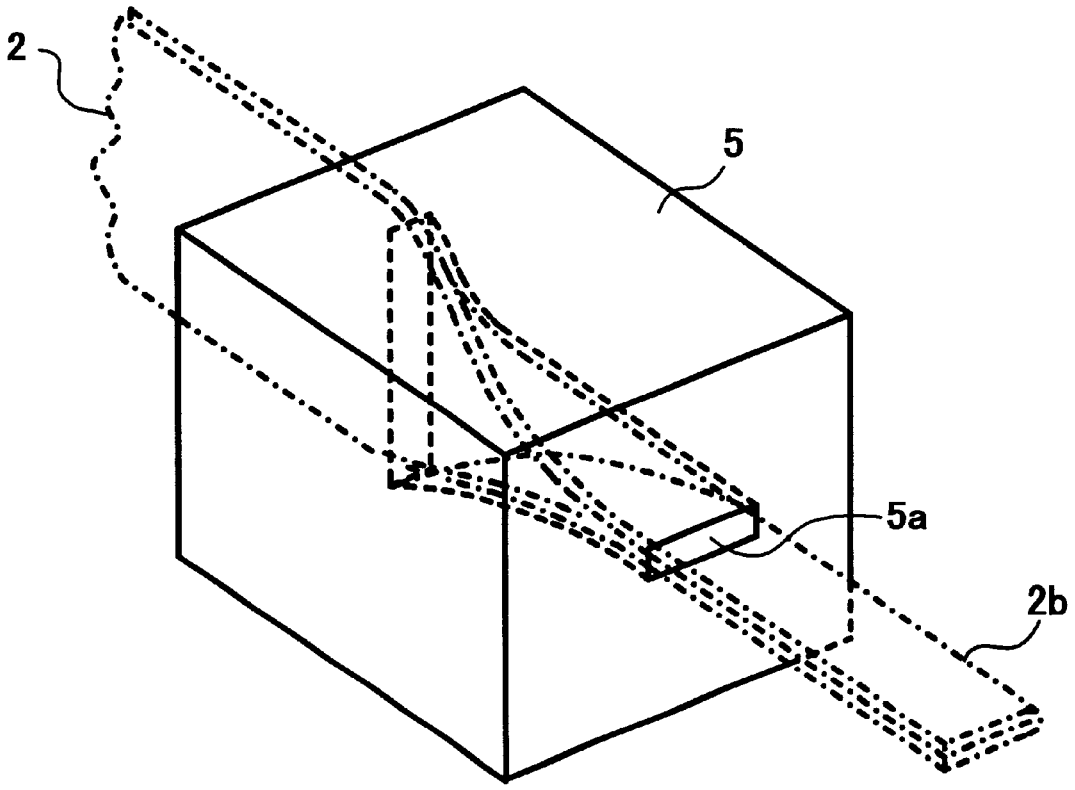
FIG. 30 is a schematic perspective view showing a state of inserting a sealing member through a seal taking-out hole sealing member of another construction.
Figure 31:
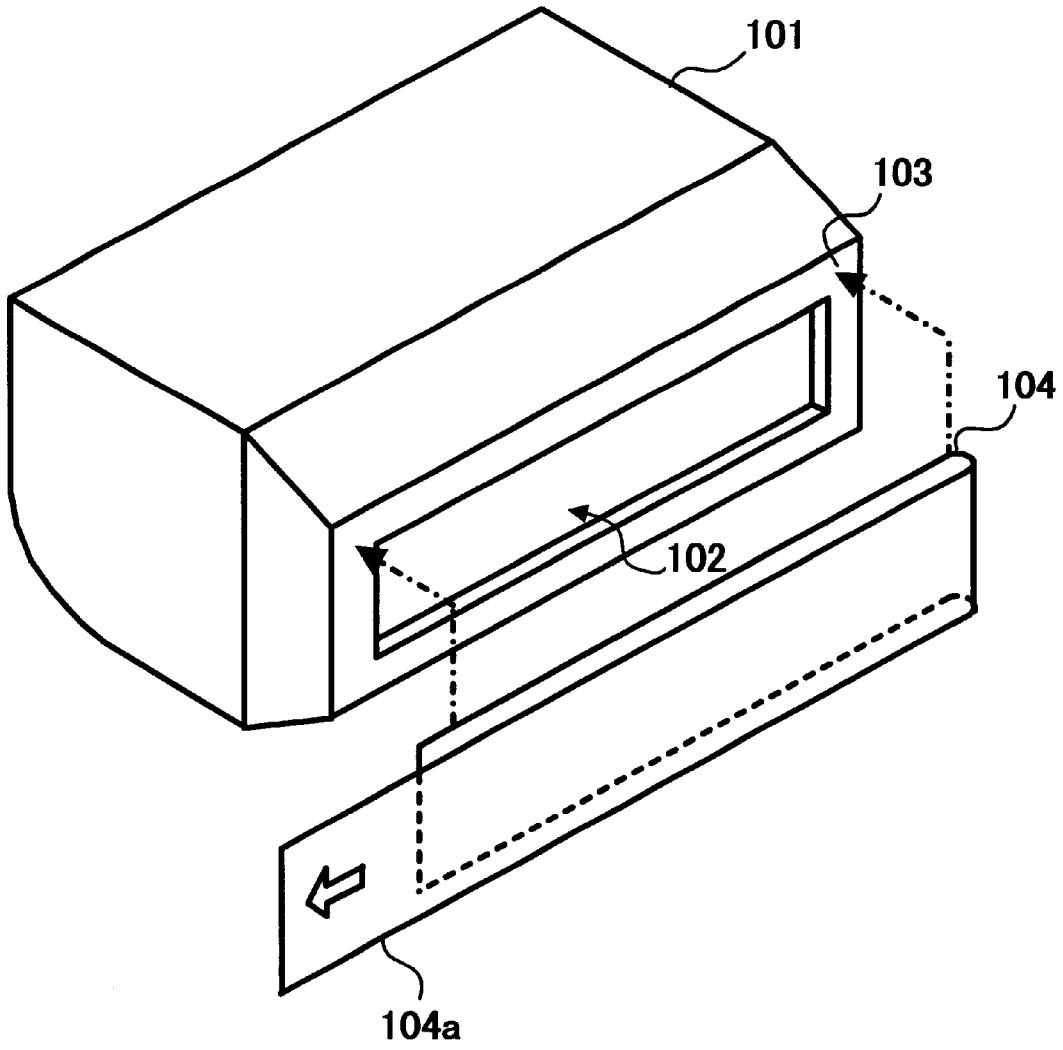
FIG. 31 BACKGROUND ART
FIG. 31 is an explanatory view showing an example of a background sealing member.

On the other hand, and as shown in FIGS. 27 and 28, for the purpose of preventing a toner-leaking and a toner-scattering from the seal taking-out hole 17*b*, the container having the seal taking-out hole 17*b* that is sealed with the taking-out hole sealing member 5 may be constructed such that the sealing member 5 prevents the toner-leaking and the toner-scattering by being provided with a seal insertion hole 5*a*, and is mounted on the seal taking-out hole 17*b* as shown in FIG. 29. Thus, a trouble for mounting the taking-out hole sealing member 5 on the seal taking-out hole 17*b* after the sealing member 2 is peeled off can be solved by mounting the taking-out hole sealing member 5 in advance on the seal taking-out hole 17*b*. Thereby, any toner-leakage and toner scattering caused by an operator forgetting a mounting of the taking-out hole sealing member 5 to the seal taking-out hole 17*b* can be prevented.

As shown in FIG. 28, the leader 2*b* of the sealing member 2 is preferably externally exposed of the seal taking-out hole 17*b* through the seal insertion hole 5*a* of the taking-out hole sealing member 5, in a state of being previously folded into the folio-like shape by keeping an opening sealing-face of the sealing member 2 inside. Thus, the sealing member 2 can easily be folded into the folio-like shape by keeping the opening sealing-face of the sealing member 2 inside at a time of the unsealing operation for the sealing member 2, by leaving the leader 2*b* of the sealing member 2 exposed outwardly through the seal insertion hole 5*a* so as to be previously folded into the folio-like shape.

Further, as for the taking-out hole sealing member 5, one having the seal insertion hole 5*a* that is previously formed into a shape for folding the sealing member 2 with the opening sealing-face thereof inside may be employed. In the taking-out hole sealing member 5, since a member that forms the seal insertion hole 5*a* of the taking-out hole sealing member 5 is previously formed into a shape for folding the sealing member 2 into the folio-like shape by keeping the opening sealing-face of the sealing member 2 inside, the opening sealing-face of the sealing member 2 can be folded inside without touching am operator's hands at a time of an unsealing operation for the sealing member 2.

A material for forming the seal insertion hole 5*a* of the taking-out hole sealing member 5 is preferably constructed with, at least, for example, a foam rubber, a foam urethane, or the like foam, having an elastic property. By constructing the member that forms the seal insertion hole 5*a* of the taking-out hole sealing member 5 with foam rubber, foam urethane, or the like foamed material, having an elastic property, the opening sealing-face is rubbed with the seal insertion hole 5*a* of the taking-out hole sealing member 5*a* at a time of an unsealing operation for the sealing member 2. Thereby, only toner 18 stuck on the opening sealing-face of the sealing member 2 can be scraped off by the foamed material that forms the seal insertion hole 5*a* of the taking-out hole sealing member 5, and thereby, a possibility of contamination by a scattered toner 18 can be decreased. Thus, when a member that forms the seal insertion hole 5*a* is constructed with foam rubber, foam urethane, or the like foamed material, having an elastic property, the member that forms the seal insertion hole 5*a* is, for example, as shown in FIGS. 27 and 28, adhered to a supporting plate 5*b* made of resin having stiffness. Then, the seal insertion hole 5*a* is mounted on the seal taking-out hole 17*b*, by providing a hooking pick 5*c* formed on the supporting plate 5*b* to the seal taking-out hole 17*b* as shown in FIG. 29.

Obviously, numerous additional modifications and variations of the present invention are possible in light of the above teachings. It is therefore to be understood that within the scope of the appended claims, the present invention may be practiced otherwise than as specifically described herein.

This application is based on Japanese patent applications JPAP09-242125 filed on Aug. 21, 1997, JPAP10-026772 filed on Jan. 22, 1998, JPAP10-048817, filed on Feb. 13, 1998, JPAP10-148448 filed on May 13, 1998, and JPAP10, the entire contents of which are hereby incorporated by reference.

What is claimed is:

1. A sealing member for sealing an opening of a container, comprising:

a sealing face facing contents in the container, the sealing face having a shape in which the sealing face is not externally exposed outwards during an unsealing operation of the sealing member;

a leader for pinching the sealing member during the unsealing operation of the sealing member; and wherein the leader extends outside of the container through a seal guide, and wherein the seal guide hole is formed on the container, and wherein the sealing face faces the contents in the container at a part of the sealing face being uplled out from the seal guide hole, when the leader of the leader of the sealing member is pulled out from the seal guide hole.

2. The sealing member according to claim 1, wherein at least a portion of the leader of the sealing member extending outside of the container through the seal guide hole is folded into a folio-like shape along an unsealing direction of the sealing member.

3. The sealing member according to claim 2, wherein the portion of the leader folded into the folio-like shape is adhered so that the folded shape is maintained prior to the unsealing operation.

4. A sealing member for sealing an opening of a container, comprising:

a sealing face facing contents in the container, the sealing face having a shape in which the sealing face is not externally exposed outwards during an unsealing operation of the sealing member;

a leader for pinching the sealing member during the unsealing operation of the sealing member; and wherein the leader extends outside of the container through a V-shaped seal guide hole for folding the sealing member into a folio-like shape.

5. A sealing member for sealing an opening of a container, comprising:

a sealing face facing contents in the container, the sealing face having a shape in which the sealing face is not externally exposed outwards during an unsealing operation of the sealing member; and a pre-formed crease for folding the sealing member into a folio-like shape formed at least at a position of a starting side of the unsealing operation of the sealing member along an unsealing direction of the sealing member.

6. A sealing member for sealing an opening of a container, comprising:

a sealing face facing contents in the container, the sealing face having a shape in which the sealing face is not externally exposed outwards during an unsealing operation of the sealing member;

wherein the sealing member is formed into a ring-like shape having a twisted portion formed by connecting an upside of a first end of the sealing member to a downside of a second end of the sealing member in a reversing manner, and the sealing member further comprising:

a leader for pinching the sealing member when the sealing member is peeled off from the container, the leader being provided at a downstream position of an unsealing direction of the twisted portion of a staring side of the ring-like formed sealing member during the unsealing operation.

7. A sealing member for sealing an opening of a container, comprising:

a sealing face facing contents in the container, the sealing face having a shape in which the sealing face is not externally exposed outwards during an unsealing operation of the sealing member; and a V-shaped leader for pinching the sealing member during the unsealing operation of the sealing member, wherein the V-shaped leader is formed by folding the sealing member at approximately a center portion with a crease in a direction perpendicular to an unsealing direction of the sealing member.

8. A container comprising:

an opening;

a sealing member for sealing the opening of the container, wherein the sealing member for sealing the opening of the container includes a sealing face facing contents in the container, the sealing face having a ring-like shape with a twisted portion in which the sealing face is not externally exposed during an unsealing operation of the sealing member which pulls the sealing member to completely remove the sealing member from the container.

9. The container according to claim 8, wherein the container is a toner cartridege for containing developer of an electrophotographic apparatus.

10. A container comprising:

an opening sealed with a sealing member; and a seal taking-out hole for taking out the sealing member when the opening is unsealed;

wherein a maximum measure of the seal taking-out hole is smaller than a width of a sealing portion perpendicular to an unsealing direction of the sealing member and the seal taking-put hole includes a convex portion.

11. The container according to claim 10, wherein the sealing member includes a leader for pinching the sealing member when the sealing member is peeled off from the container, and the leader is inserted through the seal taking-out hole so that an opening sealing-face of the sealing member is bent inside during an unsealing operation of the sealing member.

12. The container according to claim 10, wherein the container is a cartridge and the opening is an opening of a developer container for containing a developer of a developing device of an electrophotographic apparatus.

13. A container comprising:

an opening sealed with a sealing member; and a seal taking-out hole for taking out the sealing member when the opening is unsealed, and the seal taking-out hole including a convex portion;

wherein a convex protrusion is formed on the seal taking-out hole, having a shape such that a face of the sealing member can thereby be bent.

14. A container comprising:

an opening sealed with a sealing member; and a seal taking-out hole for taking out the sealing member when the opening is unsealed; and a convex protrusion formed on the seal taking-out hole, having a shape such that a face of the sealing member can be bent.

15. The container according to claim 14, wherein the sealing member for sealing the opening of the container includes a sealing face facing contents in the container, the sealing face having a shape in which the sealing face is not externally exposed during an unsealing operation of the sealing member.

16. The container according to claim 14, wherein the convex protrusion provided on the seal taking-out hole is formed into a shape such that an opening sealing-face of the sealing member can be bent inside thereof by contacting the opening sealing-face of the sealing member during an unsealing operation of the sealing member.

17. The container according to claim 14, wherein the convex protrusion is formed on an inside portion of the seal taking-out hole of the container.

18. A sealing member for sealing an opening of a container comprising:

a face of the sealing member facing contents in the container when the opening is sealed; and a covering portion formed separate from the sealing face and covering the sealing face during an unsealing portion for the opening from an end portion.

19. The sealing member according to claim 18, further comprising:

an adhesive layer for adhering an end portion of the sealing member and an end portion of the covering portion.

20. The sealing member according to claim 19, wherein the adhesive layer is provided on an end portion of the sealing member as a fixing means when the opening of the container is sealed with the sealing member.

21. The sealing member according to claim 20, wherein the adhesive layer retains an adhering property for adhering to a side of the sealing member without losing the adhesive property when the sealing member is peeled off from the container.

22. The sealing member according to claim 18, wherein the sealing member seals an opening for supplying a deveoloper in a developer container which contains a developer.

23. sealing member for sealing an opening of a container comprising:

a flexible material with a cylindrical shape; and wherein a portion of an outer peripheral face of the cylindrical sealing member is sealed;

a leader for pinching the sealing member when the sealing member is peeled off from a container, the leader being fixed at a first end portion in a longitudinal direction of the sealing member extending towards a second end portion in a longitudinal direction of the sealing member, and being inserted inside of the sealing member in a cylindrical shape.

24. A container comprising:

a sealing member for sealing an opening of the container, wherein the sealing member for sealing the opening of the container includes a sealing face facing contents in the container when the opening is sealed, and a covering portion formed separate from the sealing face and covering the sealing face during an unsealing operation for the opening from an end portion.

25. The container according to claim 24, wherein the sealing member further includes a leader for pinching the sealing memeber when the sealing member is peeled off from the container, and wherein the container is formed by fixing the sealing member on a main body of the container and the leader on the sealing member.

26. A sealing member comprising:

a lower sheet and an upper sheet, facing each other extending respecively in a peeling of direction, the lower sheet sealing an opening of a container and being capable of being peeled off the opening, and the uppre sheet fixed onto the lower sheet, wherein an opening sealing-face of the lower sheet faces contents in the container when the opening is sealed and entering between the lower sheet and the upper sheet while being reversed during a peeling off operation of the sealing member from an end portion of the opening.

27. The sealing member according tro claim 26, wherein the upper and lower sheets are disposed approximately in parallel to each other in a peeling off direction, and the lower sheet and the upper sheet are each formed of a flexible material.

28. The sealing member according to claim 26, further comprising:

a leader extending at a side of initiating an unsealing operation for unsealing the opening provided at least on one of the lower sheet and the upper sheet, wherein the leader projects from an end portion of a pulling-out side of adherred portions passing between the lower and upper sheets turning back to the leader.

29. The sealing member according to claim 28, wherein the leader is formed narrower in width than a length of an adhered portion of the lower and upper sheets along a pulling-out direction.

30. The sealing member according to claim 26, wherein the sealing member seals an opening for suppluing a developer in a developer container for containing a developer.

31. The sealing member according to claim 26, further comprising:

an adhesive layer for adhering an end portion of the lower sheet and the upper sheet provided at an end portion of the lower sheet or the upper sheet of the sealing member when the sealing member is peeled off from the container.

32. The sealing member according to claim 31, wherein the adhesive layer is used as a fixing means when the opening of the container is sealed with the lower sheet of the sealing member mounted at a terminal end portion of the lower sheet of the sealing member.

33. The sealing member according to claim 32, wherein the adhesive layer retains an adhesive property for adhering to a side of the lower sheet of the sealing member without losing the adhesive property when the sealing member is peeled off from the container.

34. A container comprising:

a sealing member for sealing an opening of the container, the sealing member including a lower sheet and an upper sheet, facing each other extending respectively in a peeling off direction, the lower sheet sealing an opening of a container and being capable of being peeled off the opening, and the upper sheet fixed onto the lower sheet, wherein an opening sealing-face of the lower sheet faces contents in the cotainer when the opening is sealed and entering between the lower sheet and the upper sheet while being reversed during a peeling off operation of the sealing member from an end portion of the opening.

35. A container comprising:

an opening sealed with a sealing member having a leader; and a seal taking-out hole for taking out the sealing member when the opening is unsealed, wherein the seal taking-out hole is sealed with a seal taking-out hole sealing member for preventing leakage and scattering from the seal taking-out hole due to an unsealing of the opening by removing the sealing member, and wherein the seal taking-out hole sealing member is mounted at the seal taking-out hole of the container to prevent the leakage and scattering, and the seal taking-out sealing member includes a seal insertion hole for inserting the sealing member when a leader of the sealing member is externally exposed from the container through the seal insertion hole.

36. The container according to claim 35, wherein the leader of the sealing member is externally exposed from the container through the seal insertion hole of the seal taking-out hole sealing member when the sealing member is folded into a folio-like shape retaining the opening sealing face thereof inside.

37. The container according to claim 35, wherein the seal insertion hole of the taking-out hole sealing member is formed so that the sealing member is folded into a folio-like shape retaining the opening sealing-face of the sealing member inside.

38. The container according to claim 35, wherein the seal insertion hole of the taking-out hole sealing member is elastic.

* * * * *